US009269336B2

(12) United States Patent
Osuga et al.

(10) Patent No.: US 9,269,336 B2
(45) Date of Patent: Feb. 23, 2016

(54) OPERATING ELEMENT DEVICE

(71) Applicant: YAMAHA CORPORATION, Hamamatsu-shi, Shizuoka-ken (JP)

(72) Inventors: Ichiro Osuga, Hamamatsu (JP); Hiroshi Harimoto, Hamamatsu (JP)

(73) Assignee: YAMAHA CORPORATION (JP)

( * ) Notice: Subject to any disclaimer, the term of this patent is extended or adjusted under 35 U.S.C. 154(b) by 0 days.

(21) Appl. No.: 14/481,252

(22) Filed: Sep. 9, 2014

(65) Prior Publication Data

US 2015/0090098 A1 Apr. 2, 2015

(30) Foreign Application Priority Data

Sep. 27, 2013 (JP) ..... 2013-202383

(51) Int. Cl.
*G10C 3/12* (2006.01)
*G10H 1/34* (2006.01)

(52) U.S. Cl.
CPC . *G10C 3/12* (2013.01); *G10H 1/346* (2013.01)

(58) Field of Classification Search
CPC ..... G10H 1/346; G10C 3/12
USPC ..... 84/433
See application file for complete search history.

(56) References Cited

U.S. PATENT DOCUMENTS

| | | | | |
|---|---|---|---|---|
| 6,002,078 | A | 12/1999 | Yoshinaga et al. | |
| 6,075,213 | A | 6/2000 | Ichiro | |
| 6,365,820 | B1 | 4/2002 | Kondo et al. | |
| 6,369,309 | B1 | 4/2002 | Nishida | |
| 8,766,076 | B2 * | 7/2014 | Ishida | 84/433 |
| 2006/0070515 | A1 | 4/2006 | Funaki et al. | |
| 2007/0295192 | A1 | 12/2007 | Watanabe | |
| 2008/0307944 | A1 | 12/2008 | Watanabe | |
| 2011/0179935 | A1 | 7/2011 | Ishida | |

FOREIGN PATENT DOCUMENTS

| | | | |
|---|---|---|---|
| EP | 1865492 | A1 | 12/2007 |
| EP | 2001012 | A1 | 12/2008 |
| JP | 5666986 | S | 6/1981 |
| JP | 7-49512 | Y2 | 11/1995 |
| JP | 2010079042 | A | 4/2010 |

OTHER PUBLICATIONS

Extended European Search Report issued in EP14186115.3, mailed Mar. 3, 2015.

* cited by examiner

*Primary Examiner* — Jianchun Qin
(74) *Attorney, Agent, or Firm* — Rossi, Kimms & McDowell LLP

(57) ABSTRACT

A key (11) is supported by key supporting portions (32) so that the key (11) can pivot. A reaction force generation member (22) is shaped like a dome to be elastically deformed by a key-depression of the key (11). At the time of the elastic deformation, the reaction force generation member (22) increases a reaction force from the beginning with an increasing amount of elastic deformation. After the reaction force reaches its peak, the reaction force generation member (22) buckles to reduce the reaction force. A normal line of a plane (P1) including a pivot axis (C) of the key (11) and a depression point of a depression portion (11*a*) is designed to be roughly parallel to an axis line (Y1) of the reaction force generation member (22) at the point in time when the reaction force of the reaction force generation member (22) reaches its peak.

18 Claims, 18 Drawing Sheets

(A)

(B)

(A)

(B)

(C)

(A)

(B)

(C)

(A)

(B)

(C)

(A)

(B)

(C)

(A)

(B)

OPERATING ELEMENT DEVICE

BACKGROUND OF THE INVENTION

1. Field of the Invention

The present invention relates to an operating element device having a reaction force generation member for generating a reaction force by elastically deforming in response to a operator's operation.

2. Description of the Related Art

Conventionally, there are keyboard musical instruments such as electronic organs and electronic pianos having reaction force generation members for exerting a reaction force against a depression of a key. For example, Japanese Examined Utility Model Application Publication No. 7-49512 discloses a keyboard apparatus having a reaction force generation member (let-off element) on a key frame (shelf board) which supports a key located above the key frame so that the key can pivot. The reaction force generation member is elastically deformed, by being depressed by the key depressed by a player, to generate a reaction force. Particularly, the reaction force generation member generates a reaction force having the property of increasing with increasing angle between which the key pivots by a depression of the key, and abruptly decreasing by buckling distortion after the reaction force has reached its peak. By providing the player a feeling of click brought about by the buckling distortion, the conventional keyboard apparatus provides the player the key-touch similar to the touch of a piano brought about by let-off.

SUMMARY OF THE INVENTION

However, the above-described conventional keyboard apparatus has a problem that the keyboard apparatus cannot provide a player with a clear feeling of click because the whole circumference of the reaction force generation member cannot buckle at one time in response to a depression of a key. This will be explained in detail with reference to FIG. 19 to FIG. 21. FIGS. 19(A) to (D) are schematic side views of a keyboard apparatus seen from the right. FIG. 19(A) indicates the keyboard apparatus of a state where a key 91 is being released. FIG. 19(B) indicates the keyboard apparatus of a state where the key 91 had been depressed, so that a depression portion 91*a* of the key 91 has started coming into contact with a top portion 92*b* of a reaction force generation member 92. FIG. 19(C) indicates the keyboard apparatus of a state where the key 91 had been depressed further, so that the reaction force of the reaction force generation member 92 has reached its peak immediately before buckling. FIG. 19(D) indicates the keyboard apparatus of a state where the key 91 had been depressed further, so that the elastic deformation of the reaction force generation member 92 has been finished to complete the key-depression. Although the keyboard apparatus shown in FIG. 19 is configured slightly differently from the keyboard apparatus described in the above-described Japanese Examined Utility Model Application Publication No. 7-49512 noted in the Description of the Related Art, the principle of the keyboard apparatus shown in FIG. 19 is the same as that of the keyboard apparatus of the Description of the Related Art. The keyboard apparatus of FIG. 19 is configured similarly to keyboard apparatuses of embodiments of the present invention which will be described later in order to facilitate comparison of operation and effect with the keyboard apparatuses of the embodiments of the invention.

In FIGS. 19 to 21 and drawings of the embodiments and their modifications of the invention which will be described later, the lateral direction is defined as the front-rear direction of the keyboard apparatuses, the front-back direction of the paper of the figures is defined as the lateral direction of the keyboard apparatuses, and the vertical direction is defined as the vertical direction of the keyboard apparatuses.

The keyboard apparatus has the key 91 which is to be depressed and released by a player, and the reaction force generation member 92 which exerts a reaction force against a player's depression of the key 91. At the rear end of the key 91, the key 91 is supported by a key supporting portion 94 erected on the rear end of a key frame 93 having a horizontal top portion so that the front end of the key 91 can pivot up and down. The center of the pivot of the key 91 is defined as a pivot axis C. The reaction force generation member 92 is fastened to the upper surface of the key frame 93 such that the reaction force generation member 92 is situated below the depression portion 91*a* which is located at a central portion in the front-rear direction of the key 91 and has a flat undersurface. The reaction force generation member 92 is integrally formed of an elastic member such as rubber to have a dome-shaped thin body portion 92*a* and a cylindrical top portion 92*b* having a flat upper surface. The central axis line extending in the vertical direction of the reaction force generation member 92 is defined as an axis line Y1. Between the key 91 and the key frame 93, a spring 95 is provided which urges the key 91 upward such that the spring 95 is situated at a middle position between the reaction force generation member 92 and the key supporting portion 94. The front end of the key 91 extends downward. At the lower end of the front end of the key 91, an engagement portion 91*b* jutting rearward is provided so that the engagement portion 91*b* is inserted through a through-hole provided on the key frame 93 from the front toward the rear beneath the key frame 93. On the undersurface of the front end of the key frame 93, a stopper member 96 is provided so that the contact between the stopper member 96 and the engagement portion 91*b* of the key 91 can restrict upward displacement of the front end of the key 91.

As for the keyboard apparatus configured as above, in a state where the key 91 is being released, as indicated in FIG. 19(A), the front end of the key 91 is urged upward by the spring 95, with the upward displacement of the key 91 being restricted by the engagement between the engagement portion 91*b* and the stopper member 96, so that the undersurface of the key 91 is situated in a horizontal position to face the upper surface of the key frame 93 in parallel, with the undersurface of the depression portion 91*a* of the key 91 being also situated in a horizontal position to face the upper surface of the top portion 92*b* of the reaction force generation member 92 in parallel. In this state, furthermore, the axis line Y1 of the reaction force generation member 92 is orthogonal to the undersurface of the depression portion 91*a*, the upper surface of the top portion 92*a*, and the upper surface of the key frame 93. When the key 91 is depressed, the key 91 pivots about the pivot axis C, so that the front end of the key 91 is displaced downward to release the engagement portion 91*b* from the stopper member 96 to make the depression portion 91*a* of the key 91 come into contact with the front end of the upper surface of the top portion 92*b* of the reaction force generation member 92 as indicated in FIG. 19(B).

When the key 91 is depressed further, the front end of the key 91 is further displaced downward, so that the body portion 92*a* of the reaction force generation member 92 starts deforming by the depression by the depression portion 91*a*. In this state, the undersurface of the depression portion 91*a* starts coming into surface contact with the upper surface of the top portion 92*b* of the reaction force generation member 92. In this case, the normal line of the undersurface of the depression portion 91*a* which is in surface contact with the upper surface of the top portion 92*b* is not parallel to the axis line Y1 of the reaction force generation member 92, but is inclined with respect to the axis line Y1. Therefore, the reaction force generation member 92 is deformed asymmetrically with respect to the axis line Y1. If the key 91 is depressed further, the reaction force exerted by the body portion 92*a* of the reaction force generation member 92 reaches its peak, so that immediately after reaching its peak, the body portion 92*a* starts buckling, as indicated in FIG. 19(C). By the buckling, the player can perceive the feeling similar to the sense of let-off that the player can perceive on a piano. Immediately before the buckling, the depression surface of the depression portion 91*a* of the key 91 (surface in contact with the top portion 92*b* of the reaction force generation member 92) is not orthogonal to the axis line Y1. Therefore, the depression force is exerted on the reaction force generation member 92 in a direction indicated by an arrow in the figure. Since the direction indicated by the arrow is not parallel to the axis line Y1 of the reaction force generation member 92, the whole circumference of the body portion 92*a* cannot buckle at one time, failing to provide the player with a clear feeling of click immediately before the buckling. Therefore, the sense of let-off brought about by this keyboard apparatus is imperfect. If the key 91 is depressed further, the elastic deformation of the reaction force generation member 92 finishes, so that the pivoting of the key 91 by the depression finishes, as indicated in FIG. 19(D).

The reason why the conventional keyboard apparatus cannot provide a clear feeling of click will be explained with reference to FIG. 20. In FIGS. 20(A) to (D), four parts obtained by dividing the dome-shaped body portion 92*a* of the reaction force generation member 92 at 90-degree intervals about the axis line Y1 are defined as four elastic bodies 92*a*1, 92*a*2, 92*a*3, and 92*a*4 which are shaped like a plate spring to indicate deformation states of the elastic bodies 92*a*1, 92*a*2, 92*a*3, and 92*a*4 depressed by the depression portion 91*a* of the key 91. The elastic body 92*a*1 is a part which is the farthest from the pivot axis C in the direction in which the key 91 extends. The elastic body 92*a*4 is a part which is the closest from the pivot axis C in the direction in which the key 91 extends. The elastic bodies 92*a*2 and 92*a*3 are middle parts between the above-described parts.

If the key 91 is in the state where the key 91 is being released as indicated in FIG. 19(A), the four elastic bodies 92*a*1, 92*a*2, 92*a*3, and 92*a*4 are apart from the depression portion 91*a* as indicated in FIG. 20(A). In a state where the key 91 is depressed to allow the depression portion 91*a* of the key 91 to start coming into contact with the upper end of the reaction force generation member 92 as indicated in FIG. 19(B), only the elastic body 92*a*1 is in contact with the depression portion 91*a*, with the other elastic bodies 92*a*2, 92*a*3 and 92*a*4 being apart from the depression portion 91*a* as indicated in FIG. 20(B). If the key 91 is depressed further, the elastic body 92*a*1 starts being deformed, so that the elastic body 92*a*1 buckles after reaching a peak reaction force. If the key 91 is depressed further, the depression portion 91*a* comes into contact with the elastic bodies 92*a*2 and 92*a*3 as well. After the contact, the elastic bodies 92*a*2 and 92*a*3 also start being deformed. Then, after the reaction forces of the elastic bodies 92*a*2 and 92*a*3 have reached their peaks, the elastic bodies 92*a*2 and 92*a*3 also buckle. If the key 91 is depressed further, the depression portion 91*a* comes into contact with the elastic body 92*a*4 as well. After the contact, the elastic body 92*a*4 also starts being deformed. Then, after the reaction force of the elastic body 92*a*4 has reached its peak, the elastic body 92*a*4 buckles. FIG. 20(C) indicates the state where the reaction force of the elastic body 92*a*4 has reached its peak, which corresponds to the keyboard apparatus of a state indicated in FIG. 19(C). If the key 91 is then depressed further, the buckling elastic bodies 92*a*1, 92*a*2, 92*a*3 and 92*a*4 are further deformed to finish deformation. FIG. 20(D) indicates a state where the deformation of all the elastic bodies 92*a*1, 92*a*2, 92*a*3 and 92*a*4 has finished, which corresponds to the keyboard apparatus of a state indicated in FIG. 19(D).

As for the four elastic bodies 92*a*1, 92*a*2, 92*a*3, and 92*a*4 which operate as described above, the respective reaction forces generated by the elastic bodies 92*a*1, 92*a*2, 92*a*3, and 92*a*4 vary to reach their peaks sequentially in response to a stroke of a depression of the key 91 as indicated in FIG. 21(A). If the respective reaction forces generated by the four elastic bodies 92*a*1, 92*a*2, 92*a*3, and 92*a*4 are combined together, a combined reaction force exhibits a plurality of peaks in response to the stroke of the depression of the key 91 as indicated in FIG. 21(B). As a result, in a case where such four elastic bodies 92*a*1, 92*a*2, 92*a*3, and 92*a*4 are provided, the player cannot perceive a reaction force having a clear feeling of click produced by one peak which is similar to the sense of let-off that could be perceived on a piano. However, since the reaction force generation member 92 is actually shaped like a dome, the reaction force exhibits a gradually varying property as indicated by broken lines in FIG. 21(B). In actuality, as a result, the player cannot perceive a reaction force having a clear peak, that is, a clear feeling of click similar to let-off on a piano.

The present invention was accomplished to solve the above-described problem, and an object thereof is to provide an operating element device which is able to generate a reaction force having a clear peak, that is, a reaction force providing a player with a clear feeling of click similar to let-off on a piano in response to a manipulation of an operating element. As for descriptions about respective constituent features of the present invention, furthermore, reference letters of corresponding components of embodiments described later are provided in parentheses to facilitate the understanding of the present invention. However, it should not be understood that the constituent features of the present invention are limited to the corresponding components indicated by the reference letters of the embodiments.

In order to achieve the above-described object, it is the first invention to provide an operating element device including a pivoting body (11, 42, 52, 62, 67) which is supported by a supporting member (32, 41, 51, 63, 68) so that the pivoting body can pivot about a pivot axis (C) in response to a force directly or indirectly exerted on the pivoting body by an operator; and a reaction force generation member (21, 22) which is elastically deformed by a depression exerted in an axis line direction (Y1) and generates a reaction force against the depression, more specifically, the reaction force generation member increasing the reaction force from a beginning with an increasing amount of elastic deformation by the depression, and buckling to reduce the reaction force after a peak of the reaction force; the pivoting body being provided with a depression portion (11*a*, 42*a*, 52*d*, 62*g*, 67*a*), with the reaction force generation member being fastened to be opposed to the depression portion, or the reaction force generation member being fastened to the pivoting body, with the depression portion (31*e*) provided on a fastened member (31) being opposed to the reaction force generation member so that the depression portion can depress the reaction force generation member in an axis line direction in response to pivoting of the pivoting body, wherein the depression portion and the reaction force generation member are configured such that the axis line direction of the reaction force generation member exists within an angle between a normal line of a plane including the pivot axis and a depression point of the depression portion at a point in time when the depression portion comes into contact with the reaction force generation member, and a normal line of the plane including the pivot axis and the depression point of the depression portion at a point in time when the depression portion finishes depressing the reaction force generation member.

In this case, it is preferable that a normal line of the plane including the pivot axis and the depression point of the depression portion at a point in time when the reaction force of the reaction force generation member reaches its peak becomes parallel to the axis line of the reaction force generation member. Furthermore, a plane on which the depression portion comes into contact with the reaction force generation member at a point in time when the reaction force generation member generates a peak reaction force may include the pivot axis of the pivoting body. For example, furthermore, the reaction force generation member gradually increases the reaction force from the beginning with an increasing amount of elastic deformation by the depression in the axis line, and buckles to abruptly reduce the reaction force after a peak of the reaction force.

According to the first invention configured as above, the normal line of the plane including the pivot axis and the depression point of the depression portion at the point in time when the reaction force of the reaction force generation member reaches its peak becomes roughly parallel to the axis line of the reaction force generation member. According to the above-described preferable example, particularly, the normal line of the plane is exactly parallel to the axis line. According to the first invention, as a result, the reaction force generation member generates a reaction force having a clear peak immediately before buckling of the reaction force generation member in response to the operation of the operating element. Therefore, the operating element device can provide the operator with a clear feeling of click immediately before the buckling to provide the operator with favorable feeling in the operation of the operating element device.

Furthermore, it is the second invention to provide an operating element device including a pivoting body (11) which is supported by a supporting member (32) so that the pivoting body can pivot about a pivot axis (C) in response to a force directly or indirectly exerted on the pivoting body by an operator; and a reaction force generation member (22) which is elastically deformed by a depression exerted in an axis line direction (Y1) and generates a reaction force against the depression, more specifically, the reaction force generation member increasing the reaction force from a beginning with an increasing amount of elastic deformation by the depression, and buckling to reduce the reaction force after a peak of the reaction force; the pivoting body being provided with a depression portion (11*a*), with the reaction force generation member being fastened to be opposed to the depression portion, or the reaction force generation member being fastened to the pivoting body, with the depression portion provided on a fastened member being opposed to the reaction force generation member so that the depression portion can depress the reaction force generation member in an axis line direction in response to pivoting of the pivoting body, wherein the depression portion and the reaction force generation member are configured such that the axis line direction of the reaction force generation member exists within an angle between a normal line of a depression surface of the depression portion against the reaction force generation member at a point in time when the depression portion comes into contact with the reaction force generation member, and a normal line of the depression surface of the depression portion against the reaction force generation member at a point in time when the depression portion finishes depressing the reaction force generation member.

In this case, it is preferable that a normal line of the depression surface of the depression portion at a point in time when the reaction force of the reaction force generation member reaches its peak becomes parallel to the axis line of the reaction force generation member. Furthermore, a plane on which the depression portion comes into contact with the reaction force generation member at a point in time when the reaction force generation member generates a peak reaction force may include the pivot axis of the pivoting body. In this case as well, furthermore, the reaction force generation member gradually increases the reaction force from the beginning with an increasing amount of elastic deformation by the depression in the axis line, and buckles to abruptly reduce the reaction force after a peak of the reaction force.

According to the second invention configured as above, the normal line of the depression surface of the depression portion at the point in time when the reaction force of the reaction force generation member reaches its peak becomes roughly parallel to the axis line of the reaction force generation member. According to the above-described preferable example, particularly, the normal line of the depression surface is more exactly parallel to the axis line. According to the second invention as well, as a result, the reaction force generation member generates a reaction force having a clear peak immediately before buckling of the reaction force generation member in response to the operation of the operating element. Therefore, the operating element device can provide the operator with a clear feeling of click immediately before the buckling to provide the operator with favorable feeling in the operation of the operating element device.

As for the first and second inventions configured as above, the depression portion and the reaction force generation member may be configured such that a normal direction of the depression surface of the depression portion with respect to the axis line of the reaction force generation member before a start of pivoting of the pivoting body is inclined toward a normal direction of the depression surface of the depression portion with respect to the axis line of the reaction force generation member before the start of pivoting of the pivoting body which allows the normal line of the depression surface of the depression portion to become parallel to the axis line of the reaction force generation member at a point in time when a contact between the depression portion and the reaction force generation member starts, against a normal direction of the depression surface of the depression portion with respect to the axis line of the reaction force generation member before the start of pivoting of the pivoting body which allows the normal line of the depression surface of the depression portion to become parallel to the axis line of the reaction force generation member at a point in time when the reaction force of the reaction force generation member reaches its peak.

By this configuration, the depression portion starts coming into surface contact with the reaction force generation member between the point in time when the depression portion starts coming into contact with the reaction force generation member and the point in time when the reaction force of the reaction force generation member reaches its peak. As a result, although the normal line of the depression surface of the depression portion cannot be exactly parallel to the axis line of the reaction force generation member at the point in time when the reaction force of the reaction force generation member reaches its peak, the depression portion starts coming into surface contact with the reaction force generation member immediately after a force is exerted on the pivoting body by the operator to allow the reaction force generation member to start elastically deforming in an adequate manner in the axis line direction immediately after the start of the operator's operation. Therefore, the operator can be provided with favorable feeling in the operation of the operating element device.

As for the first and second inventions, furthermore, the reaction force generation member may have an elastically deformable portion (21*a*, 22*a*) which is point symmetric about a center corresponding to the axis line on a plane cross section orthogonal to the axis line and is elastically deformed by a load. The elastically deformable portion may be made of an elastic material to be shaped like a dome. Such a configuration contributes to simplification of the reaction force generation member, also facilitating manufacturing of the reaction force generation member.

Furthermore, the reaction force generation member may be further provided with a base portion (22*c*) which is located beneath the elastically deformable portion and is rarely elastically deformable by load such that the base portion is fastened to a mounting surface to fasten the reaction force generation member to the mounting surface, while a thickness of the base portion is varied according to position thereof to allow the axis line direction of the reaction force generation member to incline against a normal line of the mounting surface. In this case, for example, a normal direction of an upper surface of the base portion of the reaction force generation member is parallel to the axis line of the reaction force generation member. Furthermore, the reaction force generation member may be fastened to the mounting surface inclined against the depression surface of the depression portion in a state where the operating element device is not being operated by the operator. By such a configuration, the axis line direction of the reaction force generation member can be easily inclined against the mounting surface.

DESCRIPTION OF THE PREFERRED EMBODIMENT a. First Embodiment a1. First Example

Figure 1:
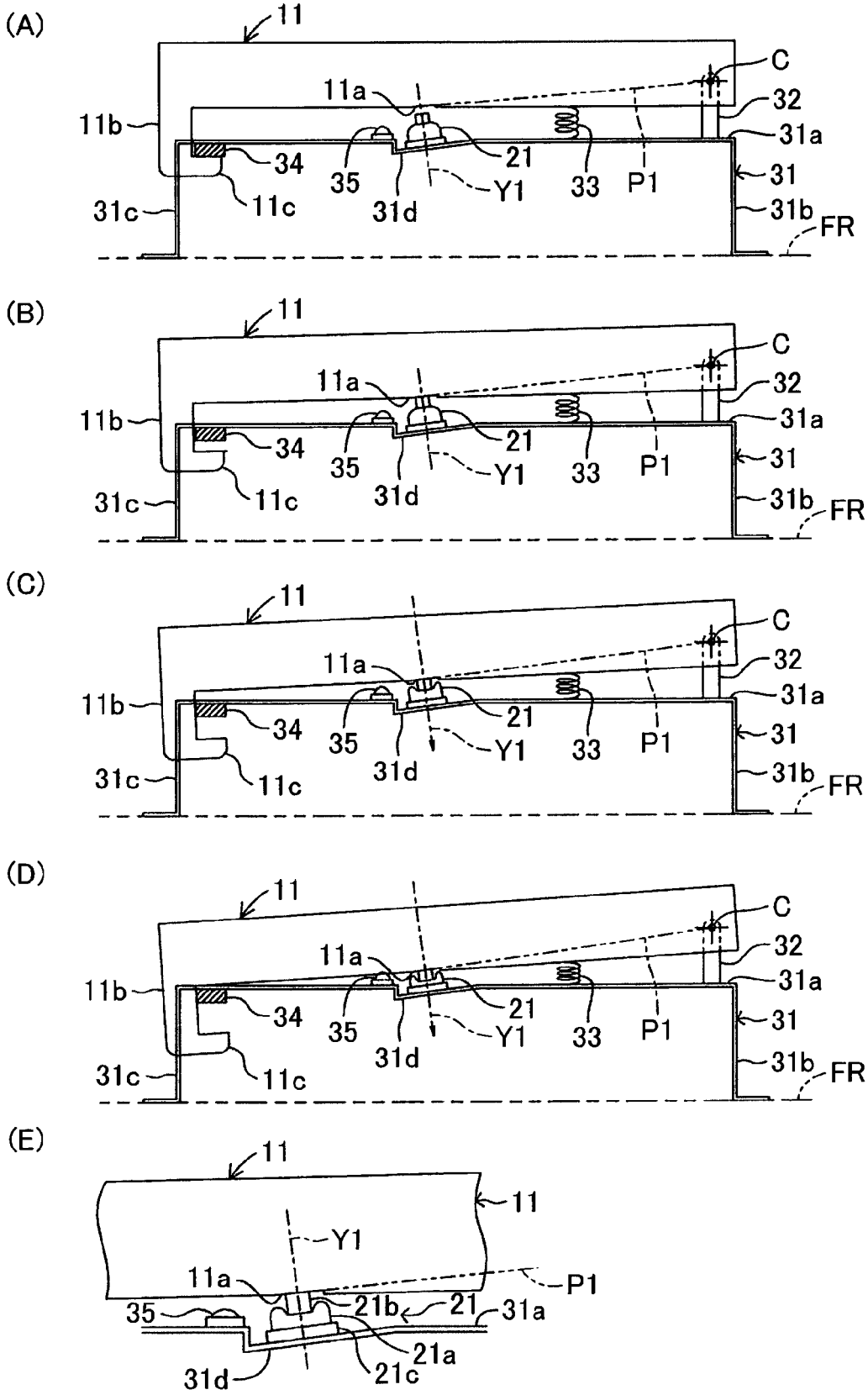
FIGS. 1(A) to (D) are schematic side views indicating states ranging from prior to the start to the end of a depression of a key of a keyboard apparatus according to the first example of the first embodiment of the present invention.
FIG. 1(E) is an enlarged view of a reaction force generation member in the state of (C)

The first example of the first embodiment of the present invention will now be described with reference to the drawings. FIG. 1(A) to (D) are schematic side views each indicative of a keyboard apparatus according to the first example seen from the right. The keyboard apparatus has a key 11 which a player depresses and releases, and a reaction force generation member 21 which exerts a reaction force in response to the player's depression of the key 11. In this case, more specifically, FIG. 1(A) indicates the keyboard apparatus in a state where the key 11 is being released and has not been depressed yet. FIG. 1(B) indicates the keyboard apparatus in a state where the key 11 has been depressed, so that a depression portion of the key has started coming into contact with the upper end of the reaction force generation member 21. FIG. 1(C) indicates the keyboard apparatus in a state where the key 11 has been depressed further, so that the reaction force generation member 21 is exerting a peak reaction force immediately before buckling. FIG. 1(D) indicates the keyboard apparatus in a state where the key 11 had been depressed further, so that the key-depression has been completed, with elastic deformation of the reaction force generation member 21 being completed. FIG. 1(E) is an enlarged view indicating the reaction force generation member 21 of FIG. 1(C). The keyboard apparatus of these figures is a constituent of the operating element device according to the present invention. In the figures, a white key is indicated as the key 11. However, black keys are configured similarly to the white keys, except that the black keys are configured to have a raised upper face of the front portion.

The key 11 is long in the front-rear direction, has a U-shaped cross-section which is open downward, and is located on a flat upper plate portion 31*a* of a key frame 31. The key frame 31 has flat leg portions 31*b* and 31*c* extending downward at the front end and the rear end of the upper plate portion 31*a*, with respective lower end portions of the leg portions 31*b* and 31*c* being fastened to a frame FR provided within a musical instrument. To the upper surface of the rear end portion of the upper plate portion 31*a* of the key frame 31, a pair of plate-like key supporting portions 32 erected to be opposed with each other inside the key 11 is fastened. On the upper portion of each key supporting portion 32, a projecting portion jutting outward is provided to face each other. The projecting portion of each key supporting portion 32 is inserted into a through-hole provided on the rear end portion of the key 11 from inside the key 11 so that the key can rotate. By such a configuration, the key 11 is supported at the rear end portion by the pair of key supporting portions 32 so that the front end portion of the key 11 can pivot up and down. Hereafter, the center of the pivoting of the key 11 will be referred to as a pivot axis C.

Figure 2:
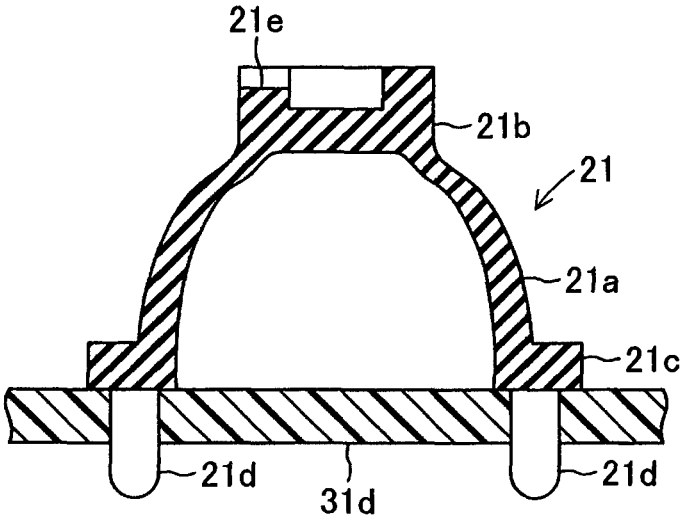
FIG. 2(A) is an enlarged cross sectional view of the reaction force generation member provided on the keyboard apparatus of FIG. 1 in a state where the reaction force generation member is not being depressed.
FIG. 2(B) is an enlarged cross sectional view of the reaction force generation member in a state where the reaction force generation member is being depressed.
Figure 2:
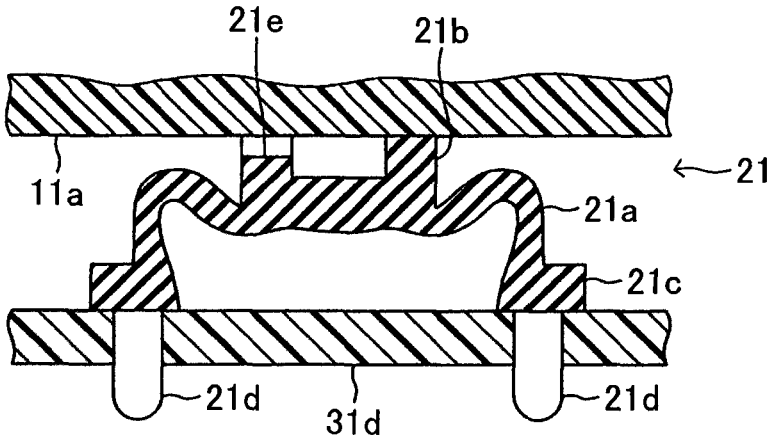

The reaction force generation member 21 is fastened to the upper surface of the upper plate portion 31*a* of the key frame 31 such that the reaction force generation member 21 is situated below a central portion of the key 11 in the front-rear direction. Hereafter, the reaction force generation member 21 will be explained. The reaction force generation member 21 is integrally formed of elastic rubber. As indicated in FIGS. 2(A) and (B), more specifically, the reaction force generation member 21 is configured by a body portion 21*a*, a top portion 21*b*, a base portion 21*c* and a pair of leg portions 21*d*. The body portion 21*a* is shaped like a dome (a bowl) which is deformable by depression from above. As for the body portion 21*a*, furthermore, an upper portion located near the top portion 21*b* is thinner than the other portion of the body portion 21*a* so that the body portion 21*a* can buckle to be deformed by a depression from above as indicated in FIG. 2(B). As a result, the reaction force generation member 21 is elastically deformed by an increasing depression from above to gradually increase a reaction force. After the reaction force has reached its peak, however, the reaction force generation member 21 buckles to sharply decrease the reaction force. The body portion 21*a* is an elastically deformable portion of the present invention.

The top portion 21*b* is shaped like a cylinder whose upper surface is open and whose lower surface is connected with the upper surface of the body portion 21*a*. The top portion 21*b* has a uniform height at all circumferences to have a flat upper surface. At a circumferential part of the upper portion of the top portion 21*b*, a notch 21*e* is provided so that air can escape between the inside and the outside of the top portion 21*b*. The base portion 21*c* juts outward from the rim of the lower end of the body portion 21*a* to be shaped like a loop (a flange). The base portion 21*c* has a uniform thickness at all circumferences. Furthermore, the base portion 21*c* has flat upper and lower surfaces. By a depression from above, the top portion 21*b* and the base portion 21*c* are slightly deformed. Compared with the body portion 21*a*, however, the amount of deformation of the top portion 21*b* and the base portion 21*c* is very slight. The pair of leg portions 21*d* juts downward from the lower surface of the base portion 21*c* to be shaped like cylinders in order to be fastened to a supporting portion 31*d* provided on the upper plate portion 31*a* of the key frame 31. Hereafter, a central axis extending in the vertical direction of the reaction force generation member 21 will be referred to as an axis line Y1.

Figure 20:
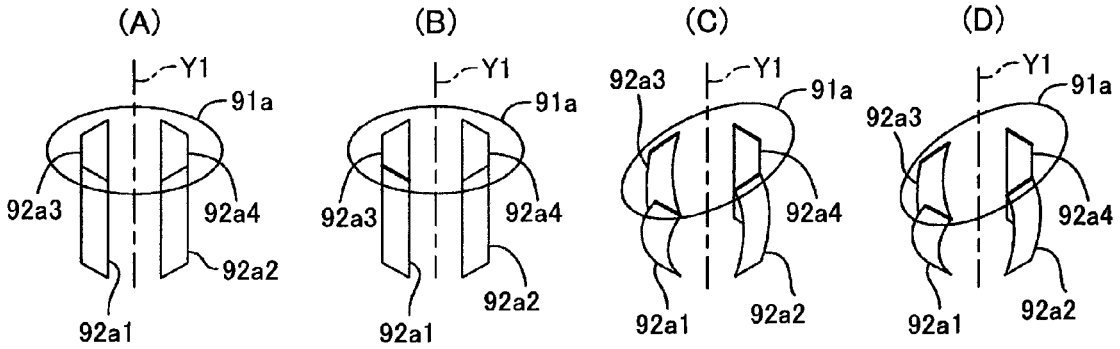
FIGS. 20(A) to (D) are diagrams indicating four elastic bodies obtained by dividing the dome-shaped body portion of the reaction force generation member according to the conventional keyboard apparatus at 90-degree intervals into four parts to indicate deformation states of the four elastic bodies in correspondence with FIG. 19.
Figure 21:
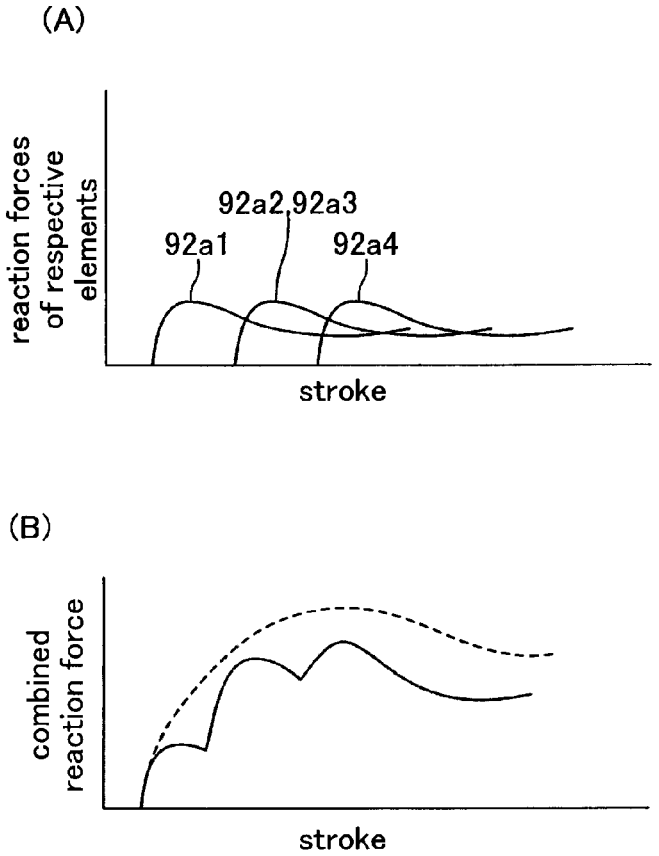
FIG. 21(A) is a graph indicative of respective reaction forces of the four elastic bodies against a stroke of a key.
FIG. 21(B) is a graph indicative of a combined reaction force obtained by combining the reaction forces generated by the four elastic bodies against the stroke of the key.

The reaction force generation member 21 configured as above is point-symmetric about a center corresponding to the axis line Y1 in a plane cross section orthogonal to the axis line Y1, while a normal line of the upper surface of the base portion 21*c* is parallel to the axis line Y1. The reaction force generation member 21 may not necessarily be shaped like a dome as long as the reaction force generation member 21 is point-symmetric as above, and is elastically deformable by an increasing depression from above to gradually increase a reaction force, and sharply decrease the reaction force by buckling distortion after the reaction force has reached its peak. For example, the reaction force generation member 21 may be configured such that a plurality of through-holes are provided on the periphery of the body portion 21*a* so that the body portion 21*a* is formed of a plurality of elastic bodies shaped like plate springs as indicated in FIG. 20 used for the explanation about weakness of the above-described conventional art and in FIG. 3 which will be described later. As a material of the reaction force generation member 21, an elastic material other than rubber may be used. Without using the leg portions 21*d* of the reaction force generation member 21, furthermore, the undersurface of the base portion 21*c* may be fastened to the upper plate portion 31*a* (the supporting portion 31*d*) of the key frame 31 with an adhesive or the like. The above-described modification of the reaction force generation member 21 will be also applied to the other embodiments and modifications which will be described later.

Next, installation of the reaction force generation member 21 on the upper plate portion 31*a* of the key frame 31 will be explained. Immediately below the key 11 to be at a position situated at the midpoint in the front-rear direction of the key 11, the supporting portion 31*d* is provided to support and fasten the reaction force generation member 21. The upper surface of the supporting portion 31*d* is flat, and is vertically tilted such that the front side is low, and the rear side is high with respect to the horizontally provided upper plate portion 31*a*. The tilted supporting portion 31*d* has a pair of through-holes. Into the pair of through-holes, the leg portions 21*d* of the reaction force generation member 21 are pressed and fitted so that the reaction force generation member 21 can be fastened by making contact between the undersurface of the base portion 21*c* and the upper surface of the supporting portion 31*d*. The above-described configuration is indicated in detail in FIG. 2, but is omitted in FIG. 1. At a position situated on the undersurface of the key 11 and opposed to the upper surface of the top portion 21*b* of the reaction force generation member 21, a depression portion 11*a* for depressing the reaction force generation member 21 from above is provided. The depression portion 11*a* is shaped like a flat plate, and has an undersurface which is flat and is vertically tilted such that the front side is low, and the rear side is high with respect to the undersurface of the key 11 provided horizontally in a state where the key is being released.

Next, the tilting angle of the upper surface of the supporting portion 31*d* with respect to the plane of the upper plate portion 31*a* other than the supporting portion 31*d* of the key frame 31, and the tilting angle of the undersurface of the depression portion 11*a* with respect to the undersurface other than the depression portion 31*d* of the key 11 will be explained. In this case, the tilting angle of the undersurface of the depression portion 11*a* is designed such that a plane obtained by extending the undersurface of the depression portion 11*a* includes a pivot axis C. Hereafter, the plane including the pivot axis C will be referred to as a plane P1. As indicated in FIGS. 1(C) and (E), the tilting angle of the depression portion 11*a* is an angle by which the depression portion 11*a* tilts with respect to the horizontal surface of the upper plate portion 31*a* excluding the supporting portion 31*d* of the key frame 31 such that the axis line Y1 of the reaction force generation member 21 is orthogonal to the plane P1 at a point in time when the reaction force of the reaction force generation member 21 reaches its peak immediately before the reaction force generation member 21 is buckled by the depression of the key 11. In other words, the undersurface of the depression portion 11*a* and the upper surface of the top portion 21*b* tilt such that a normal line of the plane P1 including the pivot axis C and a depression point (a depression surface) of the depression portion 11*a* becomes parallel to the axis line Y1 of the reaction force generation member 21 when the reaction force reaches its peak.

Furthermore, the keyboard apparatus has a spring 33 provided between the key 11 and the upper plate portion 31*a* of the key frame 31 such that the spring 33 is situated at the midpoint between the depression portion 11*a* and the key supporting portion 32. The spring 33 urges the key 11 upward with respect to the upper plate portion 31*a*. The spring 33 may not be a coil, but may be a plate spring as long as the spring can urge the key 11 upward. Such a modified spring can be also applied to the other embodiments and various modifications which will be described later. The key 11 has an extending portion 11*b* which extends downward from the front end of the key 11. At the lower end of the extending portion 11*b*, an engagement portion 11*c* jutting rearward is provided such that the engagement portion 11*c* is inserted below the upper plate portion 31*a* from the front through a through-hole provided on the key frame 31. On the undersurface of a front end portion of the upper plate portion 31*a* of the key frame 31, a stopper member 34 is provided. The stopper member 34 is a cushioning material such as felt. By coming into contact with the engagement portion 11*c* of the key 11, the stopper member 34 restricts upward displacement of the front end portion of the key 11. At a position situated on the upper surface of the key frame 31 and slightly in front of the depression portion 11*a*, a dome-shaped key switch 35 is provided. The key switch 35 varies from an off-state to an on-state by a depression of a jutting portion jutting from the undersurface of the key 11 at the time of a depression of the key to detect a player's depression/release of the key 11. The detection of the depression/release of the key by the key switch 35 is used for control of generation of a musical tone signal.

Next, the operation of the keyboard apparatus configured as above will be explained. The keyboard apparatus is designed such that in a state where the key 11 is being released, the front end of the key 11 is urged upward by the spring 33, while the upward displacement of the key 11 is restricted by the engagement between the engagement portion 11*c* and the stopper member 34 to make the undersurface excluding the depression portion 11*a* of the key 11 face the upper surface excluding the supporting portion 31*d* of the upper plate portion 31*a* in parallel to be in a horizontal position as indicated in FIG. 1(A). The undersurface of the depression portion 11*a* of the key 11 is lowered on its front side so that the undersurface is slightly inclined with respect to the horizontal plane. In this state, furthermore, the axis line Y1 of the reaction force generation member 21 is orthogonal to the upper surface of the top portion 21*b*, but is inclined with respect to the undersurface of the depression portion 11*a*.

When the key 11 is depressed, the key 11 pivots about the pivot axis C, so that the front end of the key 11 is displaced downward to release the engagement portion 11*c* from the stopper member 34 to allow the depression portion 11*a* to come into contact with the rear end of the upper surface of the top portion 21*b* as indicated in FIG. 1(B). In this state, however, the axis line Y1 of the reaction force generation member 21 is not orthogonal to the undersurface of the depression portion 11*a*, that is, to the plane P1.

If the key 11 is depressed further, the front end of the key 11 is displaced downward, so that the body portion 21*a* of the reaction force generation member 21 starts being deformed by the depression of the depression portion 11*a*. At the start of the deformation, the normal line of the contact surface between the undersurface of the depression portion 11*a* of the key 11 and the upper surface of the top portion 21*b* of the reaction force generation member 21 is slightly out of parallel with the axis line Y1 of the reaction force generation member 21. Therefore, the reaction force generation member 21 is deformed slightly asymmetrically with respect to the axis line Y1.

If the key 11 is depressed further, the reaction force of the reaction force generation member 21 reaches its peak, so that the body portion 21*a* starts buckling as indicated in FIGS.

1(C) and (E). In the state where the reaction force has reached its peak, the axis line Y1 of the reaction force generation member 21 is orthogonal to the contact surface between the depression portion 11*a* and the reaction force generation member 21 (identical with the plane P1 including the undersurface of the depression portion 11*a*). In other words, the normal line of the plane P1 including the depression surface (a set of depression points) which the depression portion 11*a* exerts a depression in order to depress against the top portion 21*b* and the pivot axis C is parallel to the axis Y1. This is because, as described above, the undersurface of the depression portion 11*a* and the upper surface of the supporting portion 31*d* are inclined, respectively, such that the axis line Y1 is orthogonal to the plane P1 including the contact surface (a set of contact points) between the depression portion 11*a* and the top portion 21*b*, and the pivot axis C at the point in time when the reaction force of the reaction force generation member 21 reaches its peak. Therefore, the depression at this point in time by the undersurface of the depression portion 11*a* against the top portion 21*b* is directed to the direction of the axis line Y1, so that the reaction force generation member 21 is to be depressed evenly in a circumferential direction about the axis line Y1. As a result, the body portion 21*a* of the reaction force generation member 21 is buckled in the entire circumference thereof at one time. Slightly later than the buckling of the reaction force generation member 21, furthermore, the key switch 35 turns from the off-state to the on-state by a depression of the jutting portion jutting from the undersurface of the key 11. In response to the change to the on-state of the key switch 35, a musical tone signal generation circuit which is not shown starts generating a musical tone signal.

If the key 11 is depressed further, the elastic deformation of the reaction force generation member 21 is completed, so that the pivoting of the key 11 by the key-depression finishes as indicated in FIG. 1(D). Then, if the key 11 is released, the front end portion of the key 11 is urged upward by the reaction force of the reaction force generation member 21 and the spring 33, so that the key 11 returns to the state where the key 11 is being released. In the course of the return to the key-release state, the key switch 35 changes from the on-state to the off-state, so that the musical tone signal generation circuit which is not shown controls the termination of the generation of the musical tone signal.

Figure 3:
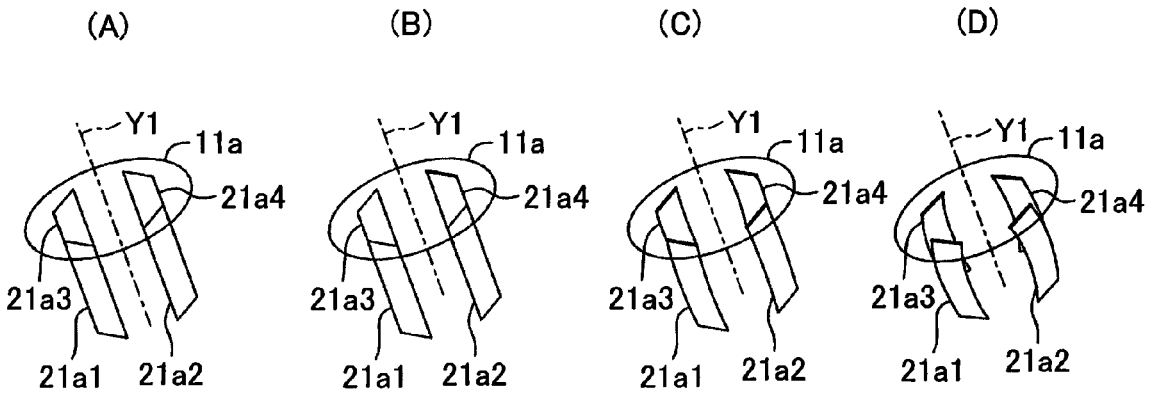
FIGS. 3(A) to (D) are diagrams indicating four elastic bodies obtained by dividing a dome-shaped body portion of the reaction force generation member according to the keyboard apparatus shown in FIG. 1 at 90-degree intervals into four parts to indicate deformation states of the four elastic bodies in correspondence with FIG. 1.

The above-described concurrent buckling in the entire circumference of the body portion 21*a* of the reaction force generation member 21 will now be explained with reference to FIG. 3. In FIGS. 3(A) to (D), similarly to the case of FIG. 20 explained in the above-described conventional art, four parts obtained by dividing the body portion 21*a* of the reaction force generation member 21 at 90-degree intervals about the axis line Y1 are defined as four elastic bodies 21*a*1, 21*a*2, 21*a*3, and 21*a*4 to indicate deformation states of the elastic bodies 21*a*1, 21*a*2, 21*a*3, and 21*a*4 depressed by the depression portion 11*a* of the key 11.

If the key 11 is in the key-release state as indicated in FIG. 1(A), all the four elastic bodies 21*a*1, 21*a*2, 21*a*3, and 21*a*4 are apart from the depression portion 11*a* as indicated in FIG. 3(A). If the key 11 is depressed to allow the depression portion 11*a* of the key 11 to start coming into contact with the upper surface of the top portion 21*b* of the reaction force generation member 21, the depression portion 11*a* comes into contact with the elastic body 21*a*4 as indicated in FIG. 3(B). If the key 11 is depressed further, the elastic body 21*a*4 starts deforming. Then, the depression portion 11*a* comes into contact with the elastic bodies 21*a*2, 21*a*3 and 21*a*1 in this order. Then, the elastic bodies 21*a*2, 21*a*3 and 21*a*1 also start deforming. As described above, respective timings at which the depression portion 11*a* comes into contact with the elastic bodies 21*a*1, 21*a*2, 21*a*3, and 21*a*4, and respective timing at which the elastic bodies 21*a*1, 21*a*2, 21*a*3, and 21*a*4 start deforming are slightly different among them. In addition, the elastic bodies 21*a*1, 21*a*2, 21*a*3, and 21*a*4 deform slightly asymmetrically with respect to the axis line Y1. In this case, the direction of the normal line of the depression surface of the depression portion 11*a* (the contact surface between the depression portion 11*a* and the top portion 21*b*) is not parallel with the axis line Y1 of the reaction force generation member 21, but is slightly inclined. Because of the above-described inclination of the upper surface of the supporting portion 31*d* and the undersurface of the depression portion 11*a*, however, the above-described differences in timing and the asymmetrical deformation are very slight.

If the key 11 is depressed further, the respective reaction forces of the elastic bodies 21*a*1, 21*a*2, 21*a*3, and 21*a*4 reach their peaks, so that the elastic bodies 21*a*1, 21*a*2, 21*a*3, and 21*a*4 buckle. FIG. 3(*c*) indicates the elastic bodies 21*a*1, 21*a*2, 21*a*3, and 21*a*4 in a state where the reaction forces have reached their peaks. In this case, the keyboard apparatus is designed such that because the normal direction of the depression surface of the depression portion 11*a* (the contact surface between the depression portion 11*a* and the top portion 21*b*) becomes parallel with the axis line Y1 of the reaction force generation member 21 because of the inclination of the upper surface of the supporting portion 31*d* and the undersurface of the depression portion 11*a* at the point in time when the reaction forces of the elastic bodies 21*a*1, 21*a*2, 21*a*3, and 21*a*4 (reaction force generation member 21) reach their peaks, the elastic bodies 21*a*1, 21*a*2, 21*a*3, and 21*a*4 concurrently exert peaked reaction forces, respectively, and then buckle concurrently. If the key 11 is depressed further, the elastic bodies 21*a*1, 21*a*2, 21*a*3, and 21*a*4 complete the deformation after the buckling to become a state indicated in FIG. 3(D).

Figure 4:
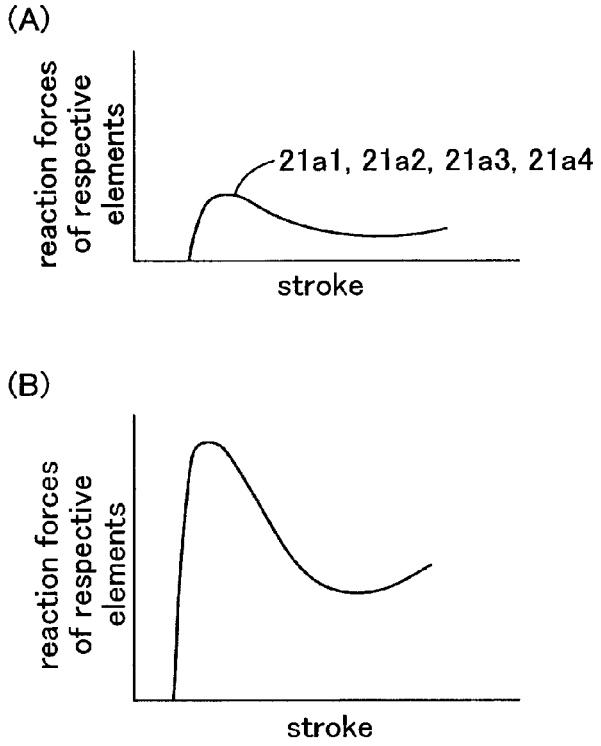
FIG. 4(A) is a graph indicative of respective reaction forces of the four elastic bodies against a stroke of a key.
FIG. 4(B) is a graph indicative of a combined reaction force obtained by combining the reaction forces generated by the four elastic bodies against the stroke of the key.

As for the four elastic bodies 21*a*1, 21*a*2, 21*a*3, and 21*a*4 which operate as described above, the respective reaction forces generated by the elastic bodies 21*a*1, 21*a*2, 21*a*3, and 21*a*4 vary to reach their respective peaks at the same timing in response to a stroke of a depression of the key 11 as indicated in FIG. 4(A). By combining the respective reaction forces generated by the four elastic bodies 21*a*1, 21*a*2, 21*a*3, and 21*a*4, a combined reaction force having a clear peak can be obtained in response to the stroke of the depression of the key 11 as indicated in FIG. 4(B). As a result, in a case where such four elastic bodies 21*a*1, 21*a*2, 21*a*3, and 21*a*4 are provided, a combined reaction force having a clear peak can be obtained. In this case as well, furthermore, the body portion 21*a* of the reaction force generation member 21 is shaped like a dome in reality. Because not only the four elastic bodies 21*a*1, 21*a*2, 21*a*3, and 21*a*4 but also the other portions of the reaction force generation member 21 have such a reaction force property shown in FIG. 4(A), the reaction force generation member 21 having the dome-shaped body portion 21*a* is to generate a reaction force of the property having a clear peak as shown in FIG. 4(B).

As explained above, the first example is designed such that the reaction force generation member 21 is made of an elastic material to be point-symmetric about the center corresponding to the axis line Y1 on the flat section orthogonal to the axis line Y1, while the body portion 21*a* is shaped like a dome to be able to buckle. Furthermore, the first example is also designed such that the normal line of the plane P1 including the pivot axis C and the depression point (depression surface) of the depression portion 11*a* of the key 11 at the point in time when the reaction force of the reaction force generation member 21 reaches its peak is parallel with the axis line Y1 of the reaction force generation member 21. According to the first example, as a result, in response to a depression of the key 11, the reaction force generation member 21 generates a reaction force having a clear peak immediately before buckling. Therefore, a player can recognize a clear feeling of click immediately before the buckling, so that the first example can provide the player with the touch of keys similar to the touch of let-off perceived on a piano.

The first example is designed such that the normal line of the plane P1 including the pivot axis C and the depression point (depression surface) of the depression portion 11*a* of the key 11 at the point in time when the reaction force of the reaction force generation member 21 reaches its peak is parallel with the axis line Y1 of the reaction force generation member 21. However, an angle for which the key 11 pivots from the state (state of FIG. 1(B)) where the depression portion 11*a* starts coming into contact with the top portion 21*b* of the reaction force generation member 21 to the state (state of FIG. 1(D)) where the depression portion 11*a* finishes depressing the reaction force generation member 21 is small. Therefore, the key 11 and the reaction force generation member 21 may be designed such that the direction of the axis line Y1 of the reaction force generation member 21 exists within the angle between the normal line of the plane including the pivot axis C and the depression point of the depression portion 11*a* at the point in time when the depression portion 11*a* comes into contact with the top portion 21*b* and the normal line of the plane including the pivot axis C and the depression point of the depression portion 11*a* at the point in time when the depression portion 11*a* finishes depressing the reaction force generation member 21. By such a configuration as well, the respective portions of the reaction force generation member 21 situated around the axis line Y1 are depressed toward a direction close to the axis line Y1 by the depression portion 11*a* to buckle during a period in time ranging from the state where the depression portion 11*a* starts coming into contact with the top portion 21*b* of the reaction force generation member 21 to the state where the depression portion 11*a* finishes depressing the reaction force generation member 21. By this configuration as well, therefore, the reaction force generation member 21 generates a reaction force having a clear peak immediately before the buckling. As a result, the player can recognize a clear feeling of click immediately before the buckling, so that this configuration can provide the player with the touch of keys similar to the touch of let-off perceived on a piano. This configuration can be also applied to the second and third examples which will be described later.

Furthermore, the first example is designed such that the undersurface of the depression portion 11*a* is inclined with respect to the undersurface other than the depression portion 11*a* of the key 11 so that the undersurface of the depression portion 11*a* can be parallel with the upper surface of the supporting portion 31*d* at the point in time when the reaction force generated by the reaction force generation member 21 reaches its peak. However, because the inclined angle is slight, the first example may be designed such that the undersurface of the depression portion 11*a* is even or parallel with the undersurface other than the depression portion 11*a* of the key 11. This can be also applied to the later-described second and third examples.

a2. Second Example

Figure 5:
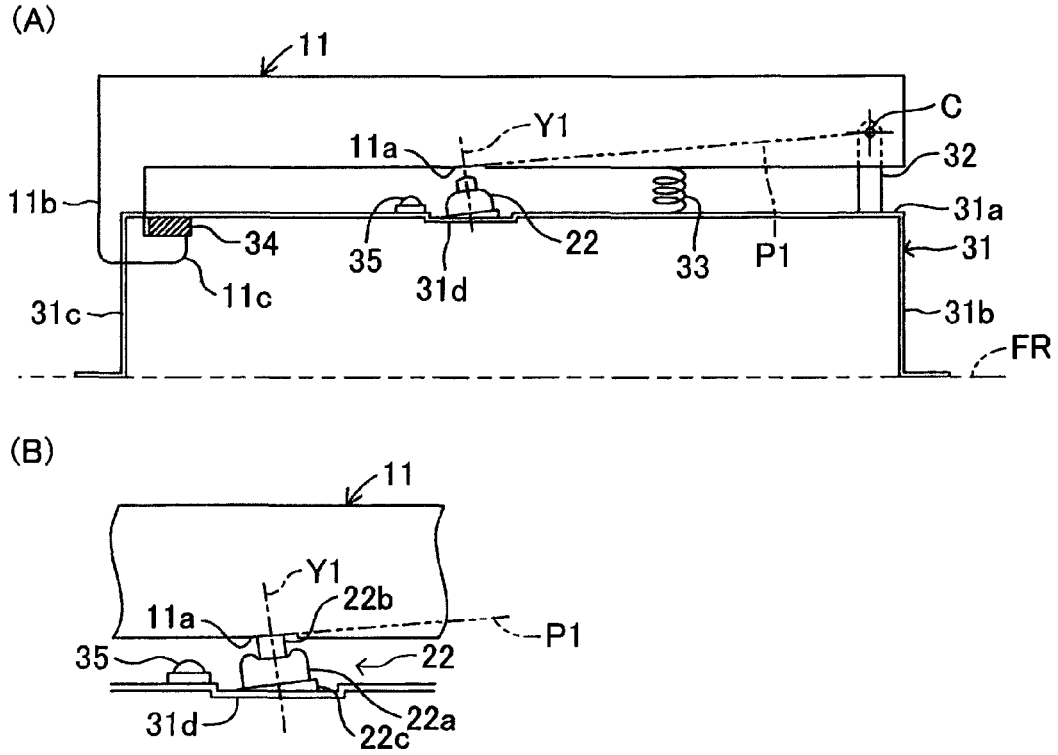
FIG. 5(A) is a schematic side view of the keyboard apparatus whose key is being released according to the second example of the first embodiment of the present invention.
FIG. 5(B) is an enlarged view of the reaction force generation member of the keyboard apparatus in a state where the reaction force of the reaction force generation member has reached its peak.

Next, a keyboard apparatus according to the second example of the first embodiment will be explained with reference to FIG. 5. FIG. 5(A) is a side view in which the keyboard apparatus whose key 11 is being released (before start of a key-depression) is seen from the right. FIG. 5(B) is an enlarged view of a reaction force generation member 22 which is generating a peak reaction force. In this example as well, the reaction force generation member 22 has a body portion 22*a*, a top portion 22*b* and a base portion 22*c* (see FIG. 5(B)). However, the base portion 22*c* is designed such that in a state where the base portion 22*c* is fixed to the supporting portion 31*d* of the upper plate portion 31*a* of the key frame 31, the base portion 22*c* has a thin front portion, and gradually becomes thicker toward the rear. The supporting portion 31*d* to which the undersurface of the base portion 22*c* is fastened is slightly lower than the upper surface of the upper plate portion 31*a* excluding the supporting portion 31*d*, but is situated in a horizontal position. In this example as well, the normal line of the upper surface of the base portion 22*c* is parallel to the axis line Y1, as in the case of the first example. The other parts of the reaction force generation member 22 are similar to the reaction force generation member 21 of the first example. Furthermore, the inclination of the undersurface of the depression portion 11*a* is similar to that of the first example. Furthermore, the second example is also designed such that the plane extending from the undersurface of the depression portion 11*a* includes the pivot axis C to define the plane including the pivot axis C as the plane P1. However, the axis line Y1 is a central axis of the dome-shaped body portion 22*a* and the cylindrical top portion 22*b* of the reaction force generation member 22. Because the configuration other than the above of the second example is similar to that of the first example, similar parts of the second example are given the same numbers as the first example to omit explanations about the parts.

In the second example, as described above, the axis line Y1 of the reaction force generation member 22 is inclined with respect to the upper plate portion 31*a* of the horizontal key frame 31 by varying the thickness in the front-rear direction of the base portion 22*c* of the reaction force generation member 22. By the inclination of the upper plate portion 31*a* and the inclination of the undersurface of the depression portion 11*a*, furthermore, the axis line Y1 of the reaction force generation member 22 becomes orthogonal to the plane P1 at the point in time when the reaction force of the reaction force generation member 22 reaches its peak.

As for the second example configured as above as well, in response to a player's depression and release of the key 11, the reaction force generation member 22 operates similarly to the case of the first example. In response to the depression of the key 11, more specifically, the reaction force generation member 22 elastically deforms to buckle. At the point in time when the reaction force of the reaction force generation member 22 reaches its peak immediately before the buckling, furthermore, the normal line of the plane P1 becomes parallel to the axis line Y1 of the reaction force generation member 22 (see FIG. 5(B)). Similarly to the case of the first example, as a result, the second example can also allow the reaction force generation member 22 to generate a reaction force having a clear peak immediately before the buckling in response to the depression of the key 11. As a result, the player can recognize a clear feeling of click immediately before the buckling, so that second example can provide the player with the touch of keys similar to the touch of let-off perceived on a piano.

The second example is designed such that the supporting portion 31*d* of the key frame 31 is lower than the other parts of the upper plate portion 31*a*. However, the second example may be modified such that the supporting portion 31*d* is provided on the same plane as the upper plate portion 31*a* excluding the supporting portion 31*d*. In this modification, the key supporting portions should be slightly raised, with the extending portion 11*b* being made slightly long. Furthermore, the second example is designed such that only by varying the thickness in the front-rear direction of the base portion 22*c*, the axis line Y1 of the reaction force generation member 22 is inclined with respect to the upper plate portion 31*a*. However, the second example may be modified such that not only by varying the thickness in the front-rear direction of the base portion 22*c* but also by slightly inclining the supporting portion 31*d* with respect to the horizontal position, the reaction force generation member 22 is inclined so that the axis line Y1 can become orthogonal to the plane P1 at the point in time when the reaction force reaches its peak. In this modification, the difference in the thickness in the front-rear direction of the base portion 22*c* of the reaction force generation member 22 should be milder than the case of the second example.

a3. Third Example

Figure 6:
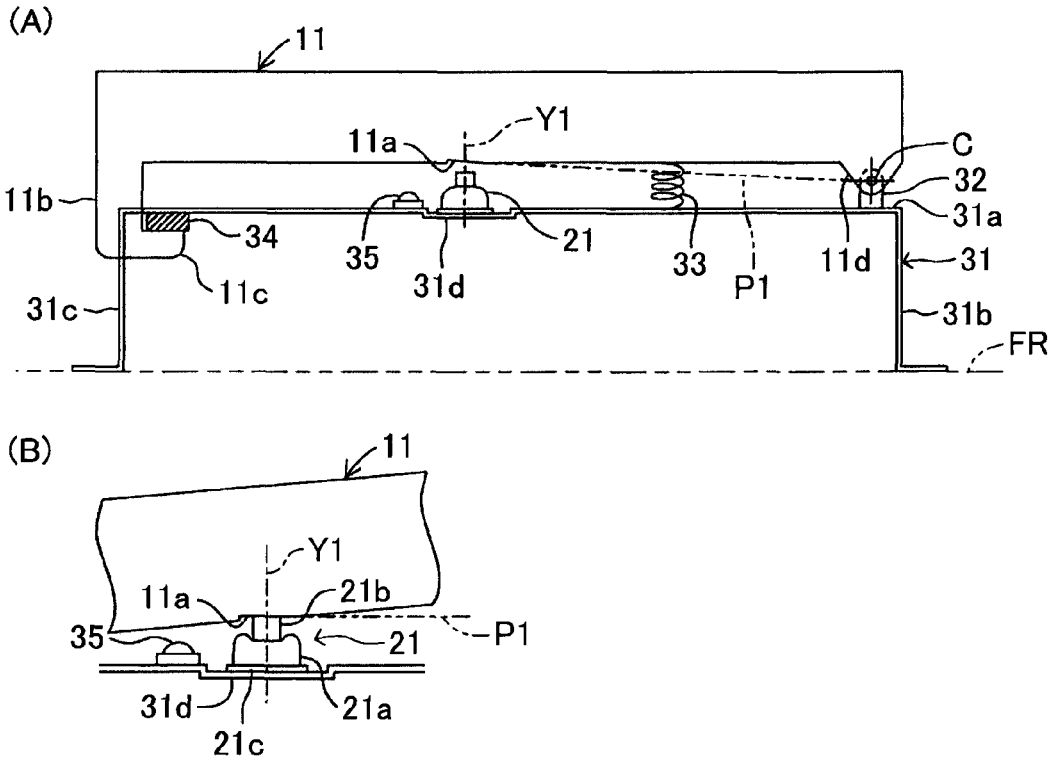
FIG. 6(A) is a schematic side view of the keyboard apparatus whose key is being released according to the third example of the first embodiment of the present invention.
FIG. 6(B) is an enlarged view of the reaction force generation member of the keyboard apparatus in a state where the reaction force of the reaction force generation member has reached its peak.

Next, a keyboard apparatus according to the third example of the first embodiment will be explained with reference to FIG. 6. FIG. 6(A) is a side view in which the keyboard apparatus whose key 11 is being released (before start of a key-depression) is seen from the right. FIG. 6(B) is an enlarged view of the reaction force generation member 21 which is in a state where the reaction force generation member 21 is generating a peak reaction force. In this example as well, to the upper surface of the rear end portion of the upper plate portion 31*a* of the key frame 31, a pair of plate-like key supporting portions 32 erected to be opposed with each other inside the key 11 is fastened. On the upper portion of each key supporting portion 32, a projecting portion jutting outward is provided to face each other. The projecting portion of each key supporting portion 32 is inserted into a through-hole provided on the rear end portion of the key 11 from inside the key 11 so that the key 11 can rotate.

However, the third example is designed such that the key supporting portions 32 are lower than those of the first and second examples. Therefore, through-holes which are provided on the key 11 and into which the projecting portions of the key supporting portions 32 are inserted such that key 11 can rotate are provided on convex portions 11*d* made by jutting the undersurface of the rear end portion of the key 11 downward. In this example as well, the key 11 is supported at the rear end portion by the pair of key supporting portions 32 so that the front end portion of the key 11 can pivot up and down, with the pivot axis being defined as the pivot axis C. Compared with the case of the first example, however, the pivot axis C is situated near the upper plate portion 31*a* of the key frame 31. Furthermore, the reaction force generation member 21 is configured similarly to that of the first example to have the body portion 21*a*, the top portion 21*b*, and the base portion 21*c*, with the thickness of the base portion 21*c* being even (see FIG. 6(B)). The supporting portion 31*d* to which the undersurface of the base portion 21*c* is fastened is designed to be slightly lower than the upper surface of the upper plate portion 31*a* excluding the supporting portion 31*d* to be situated in a horizontal position. Therefore, the axis line Y1 of the reaction force generation member 21 is orthogonal to the horizontal upper surface of the upper plate portion 31*a* of the key frame 31.

In the third example as well, at a position situated on the undersurface of the key 11 and opposed to the upper surface of the top portion 21*b* of the reaction force generation member 21, the depression portion 11*a* for depressing the reaction force generation member 21 from above is provided. The depression portion 11*a* has an undersurface which is flat and is vertically tilted contrary to the first example such that the front side is high, and the rear side is low with respect to the undersurface of the key 11 provided in a horizontal position in a state where the key is being released. The third example is also designed such that a plane obtained by extending the undersurface of the depression portion 11*a* includes the pivot axis C. The plane including the pivot axis C will be referred to as the plane P1. The third example is designed such that the undersurface of the depression portion 11*a* is tilted such that the axis line Y1 of the reaction force generation member 21 becomes orthogonal to the plane P1 at the point in time when the reaction force of the reaction force generation member 21 reaches its peak. Because the configuration other than the above of the third example is similar to that of the first example, similar parts are given the same numbers as the first example to omit explanations about the parts.

As described above, the third example is designed such that the vertical position of the pivot axis C of the key 11 is low, while the thickness of the base portion 21*c* of the reaction force generation member 21 is even, with the supporting portion 31*d* being situated in a horizontal position to allow the axis line Y1 to be orthogonal to the horizontal surface of the upper plate portion 31*a* of the key frame 31. Furthermore, the third example is designed such that the undersurface of the depression portion 11*a* is inclined so that the front side is higher than the rear side with respect to the undersurface excluding the depression portion 11*a* of the key 11 to allow the axis line Y1 of the reaction force generation member 21 to be orthogonal to the plane P1 at the point in time when the reaction force of the reaction force generation member 21 reaches its peak.

As for the third example configured as above as well, in response to a player's depression and release of the key 11, the reaction force generation member 21 operates similarly to the case of the first example. In response to the depression of the key 11, more specifically, the reaction force generation member 21 is elastically deformed to buckle. At the point in time when the reaction force of the reaction force generation member 21 reaches its peak immediately before the buckling, furthermore, the normal line of the plane P1 becomes parallel to the axis line Y1 of the reaction force generation member 21 (see FIG. 6(B)). Similarly to the case of the first example, as a result, the third example can also allow the reaction force generation member 21 to generate a reaction force having a clear peak immediately before the buckling in response to the depression of the key 11. As a result, the player can recognize a clear feeling of click immediately before the buckling, so that the third example can provide the player with the touch of keys similar to the touch of let-off perceived on a piano.

In the third example, the supporting portion 31*d* of the key frame 31 is lower than the other parts of the upper plate portion 31*a*. However, as long as the contact surface between the undersurface of the depression portion 11*a* and the upper surface of the top portion 21*b* of the reaction force generation member 21 at the point in time when the reaction force reaches its peak can be low, the third example may be modified such that the supporting portion 31*d* is situated on the same plane as the upper plate portion 31*a* excluding the supporting portion 31*d*. In a case where it is impossible to make the contact surface between the undersurface of the depression portion 11*a* and the upper surface of the top portion 21*b* of the reaction force generation member 21 at the point in time when the reaction force reaches its peak be situated in a horizontal position, the third example may be modified to slightly incline the supporting portion 31*d* with respect to the horizontal position as in the case of the first example, or to vary the thickness in the front-rear direction of the base portion 21*c* of the reaction force generation member 21 as in the case of the second example.

a4. First Modification

Figure 7:
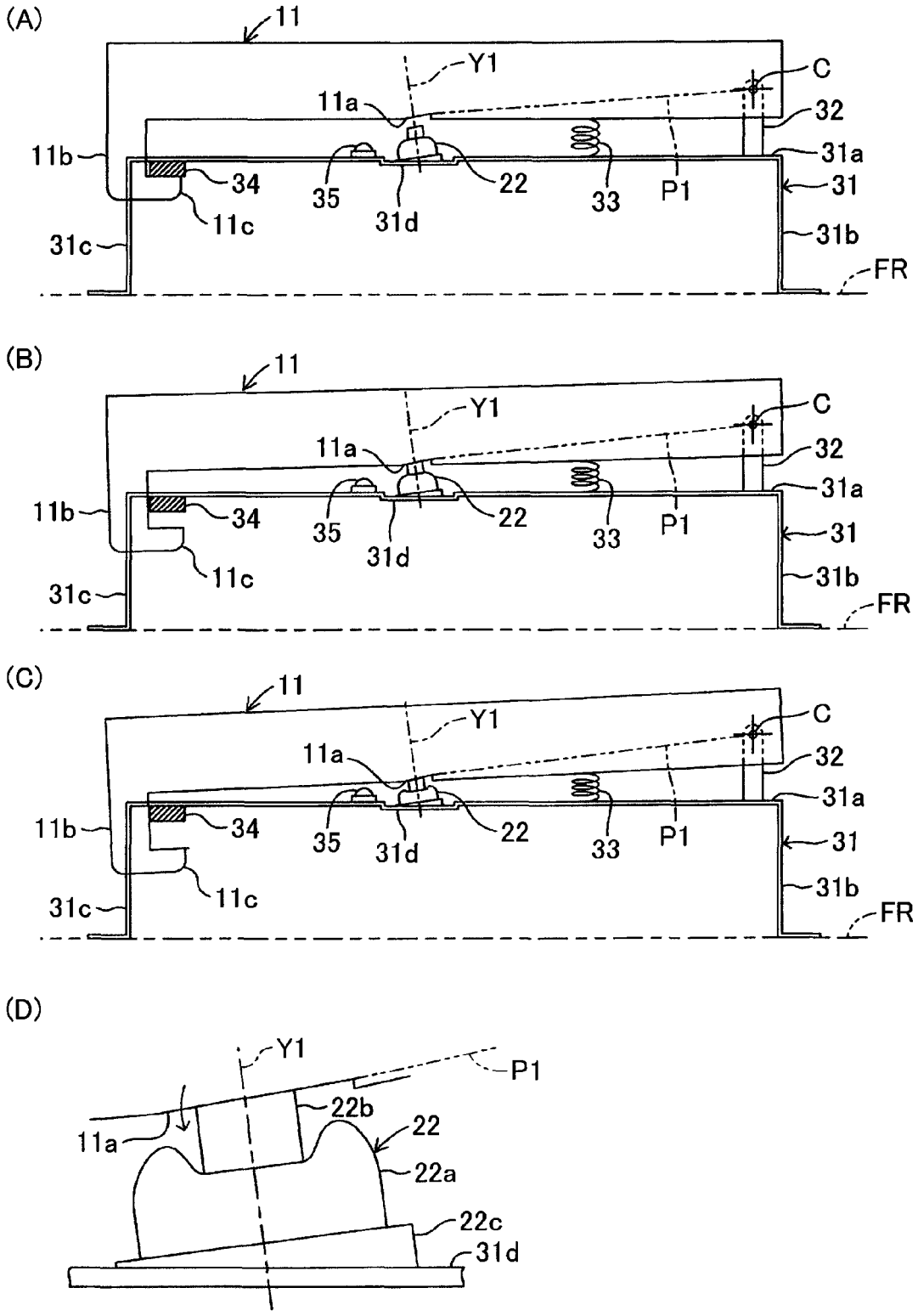
FIGS. 7(A) to (C) are schematic side views indicating states ranging from prior to the start of a depression of the key of the keyboard apparatus to the peak of the reaction force according to the first modification of the first embodiment.
FIG. 7(D) is an enlarged view of the reaction force generation member in the state of (C)

Next, the first modification of the first embodiment will be explained with reference to FIG. 7. FIG. 7(A) is a side view in which the keyboard apparatus whose key 11 is being released (before start of a key-depression) is seen from the right. FIG. 7(B) is a side view in which the keyboard apparatus in a state where the key 11 had been depressed, so that the depression portion 11*a* of the key has started coming into contact with the upper end of the reaction force generation member 22 is seen from the right. FIG. 7(C) is a side view in which the keyboard apparatus in a state where the key 11 had been depressed further, so that the reaction force has reached its peak immediately before the reaction force generation member 21 buckles is seen from the right. FIG. 7(D) is an enlarged view of the reaction force generation member 22 of FIG. 7(C). In this modification as well, similarly to the second example, the reaction force generation member 22 has the body portion 22*a*, the top portion 22*b* and the base portion 22*c*. The thickness of the base portion 22*c* varies in the front-rear direction. In addition, the direction of the axis line Y1 of the reaction force generation member 22 is the same as that of the second example.

However, as indicated by an arrow shown in FIG. 7(D), the first modification is designed such that the front side of the undersurface the depression portion 11*a* is further lowered than the rear side with respect to the undersurface of the key 11, compared with the second example, so that the first modification has a greater inclination of the depression portion 11*a* in the direction shown by the arrow. In other words, the normal line of the undersurface (depression surface) of the depression portion 11*a* is slightly inclined toward the horizontal direction, compared with the second example. Furthermore, the first modification is also designed such that the plane extending from the undersurface of the depression portion 11*a* includes the pivot axis C to define the plane including the pivot axis C as the plane P1. In addition, the first modification is designed such that because of the inclination of the undersurface of the depression portion 11*a*, the undersurface of the depression portion 11*a* comes into surface contact with the upper surface of the top portion 22*b* at the point in time when the depression portion 11*a* comes into contact with the top portion 22*b* of the reaction force generation member 22. Because the configuration other than the above of the first modification is similar to that of the second example, similar parts of the first modification are given the same numbers as the second example to omit explanations about the parts.

By such a configuration, in response to a player's depression and release of the key 11, the reaction force generation member 22 operates almost similarly to the case of the second example. In the first modification, however, as described above, in response to a depression of the key 11, at the point in time when the depression portion 11*a* starts coming into contact with the top portion 22*b* of the reaction force generation member 22, the undersurface of the depression portion 11*a* comes into surface contact with the upper surface of the top portion 22*b*. In this state, therefore, the axis line Y1 of the reaction force generation member 22 becomes orthogonal to the plane P1. In other words, the normal line of the undersurface of the depression portion 11*a* coincides with the axis line Y1. Resultantly, the reaction force generation member 22 starts deforming symmetrically with respect to the axis line Y1. If the key 11 is depressed further, the depression portion 11*a* keeps deforming the reaction force generation member 22 without any change in the contact position because of the friction between the undersurface of the depression portion 11*a* and the upper surface of the top portion 22*b*. At the point in time when the reaction force of the reaction force generation member 22 reaches its peak, the axis line Y1 of the reaction force generation member 22 is not orthogonal to the plane P1 nor to the undersurface of the depression portion 11*a*. At this point in time, therefore, the lower front end of the top portion 22*b* has been depressed slightly lower than the rear lower end of the top portion 22*b*.

Therefore, the deformed reaction force generation member 22 at the point in time when the reaction force has reached its peak is slightly asymmetrical with respect to the axis line Y1. However, because the asymmetry is trivial, the reaction force generation member 22 can generate a reaction force having a clear peak immediately before buckling in response to the depression of the key 11, similarly to the second example. As a result, the player can recognize a clear feeling of click immediately before the buckling, so that the first modification can provide the player with the touch of keys similar to the touch of let-off perceived on a piano. Furthermore, because the undersurface of the depression portion 11*a* comes into surface contact with the upper surface of the top portion 22*b* of the reaction force generation member 22 at the point in time when the depression portion 11*a* starts coming into contact with the top portion 22*b*, the reaction force generation member 22 starts elastically deforming in an appropriate manner in the axis line direction immediately after the start of player's key-depression. As a result, the first modification can provide the player with favorable key touch.

The first modification is designed such that the undersurface of the depression portion 11*a* is inclined to have a certain amount of inclination angle with respect to the undersurface of the key 11 so that the undersurface of the depression portion 11*a* can be in surface contact with the upper surface of the top portion 22*b* at the point in time when the depression portion 11*a* starts coming into contact with the top portion 22*b* of the reaction force generation member 22. However, the first modification may be modified such that the inclination angle of the undersurface of the depression portion 11*a* with respect to the undersurface of the key 11 falls within a range between the inclination angle of the second example and the above-described certain amount of inclination angle. More specifically, the first modification may be modified such that the inclination angle of the undersurface of the depression portion 11*a* with respect to the undersurface of the key 11 falls within the range between the inclination angle which allows the axis line Y1 of the reaction force generation member 22 to become orthogonal to the undersurface of the depression portion 11*a* at the point in time when the reaction force reaches its peak, and the inclination angle which allows the undersurface of the depression portion 11*a* to come into surface contact with the upper surface of the top portion 22*b* of the reaction force generation member 22 at the point in time when the depression portion 11*a* starts coming into contact with the top portion 22*b*. Since such a modification can also allow the undersurface of the depression portion 11*a* to come into surface contact with the upper surface of the top portion 22*b* immediately after the start of the contact between the depression portion 11*a* and the top portion 22*b* of the reaction force generation member 22, the modification can also expect the above-described effect.

The first modification is designed similarly to the second example such that the thickness of the base portion 22*c* varies in the front-rear direction in order to incline the axis line Y1 of the reaction force generation member 22 with respect to the vertical position. However, the first modification may be modified, similarly to the first example, such that the supporting portion 31*d* is slightly inclined with respect to the horizontal position in order to incline the axis line Y1 of the reaction force generation member 22 with respect to the vertical position. In addition to the slight inclination of the supporting portion 31*d* with respect to the horizontal position, furthermore, the thickness of the base portion 22*c* may be varied in the front-rear direction. These modifications can be also applied to the third example.

a5. Second Modification

Figure 8:
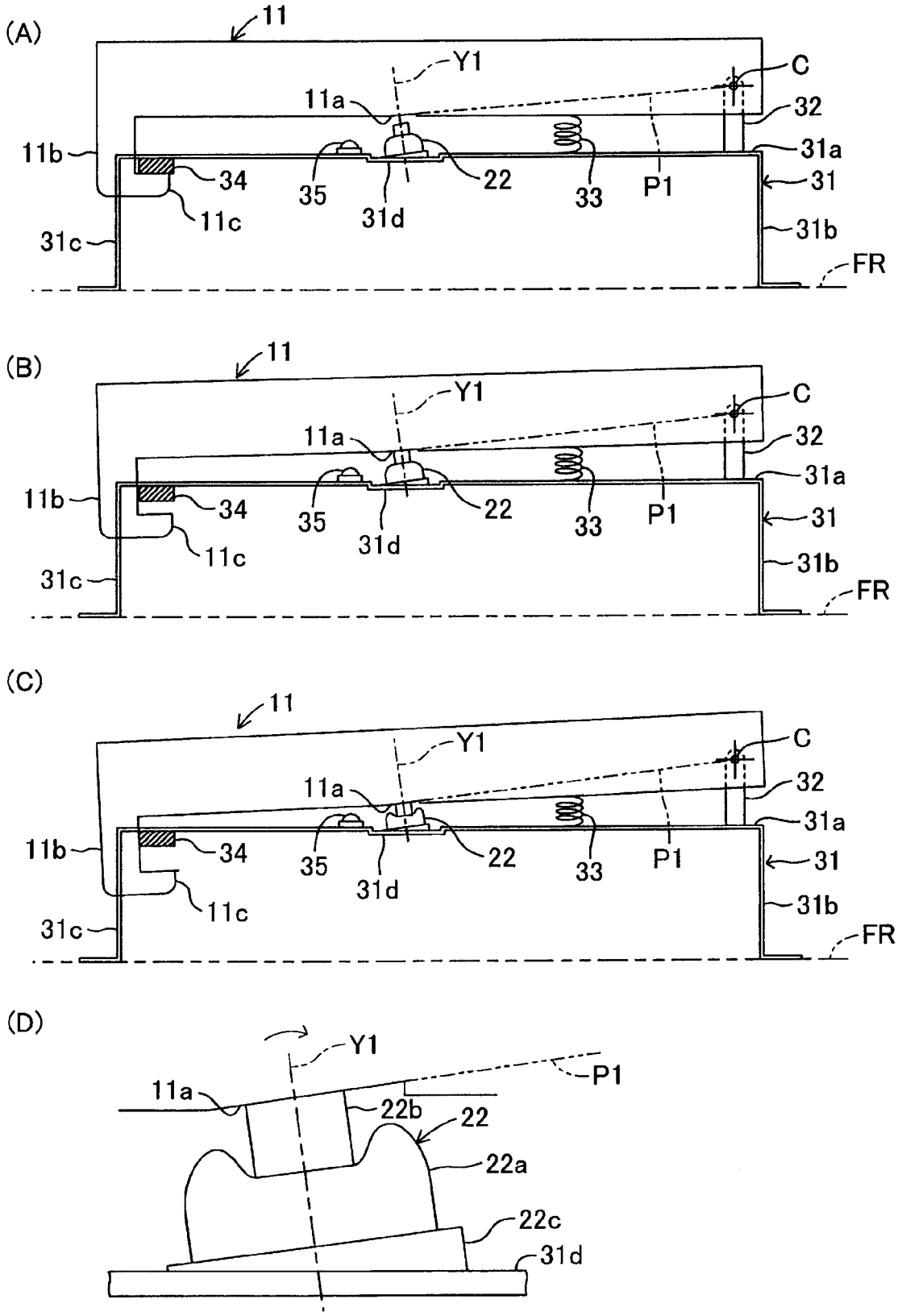
FIGS. 8(A) to (C) are schematic side views indicating states ranging from prior to the start of a depression of the key of the keyboard apparatus to the peak of the reaction force according to the second modification of the first embodiment.

Next, the second modification of the first embodiment will be explained with reference to drawings. FIG. 8(A) is a side view in which the keyboard apparatus whose key 11 is being released (before start of a key-depression) is seen from the right. FIG. 8(B) is a side view in which the keyboard apparatus in a state where the key 11 had been depressed, so that the depression portion 11*a* of the key 11 has started coming into contact with the upper end of the reaction force generation member 22 is seen from the right. FIG. 8(C) is a side view in which the keyboard apparatus in a state where the key had been depressed further, so that the reaction force has reached its peak immediately before the buckling of the reaction force generation member 22 is seen from the right. FIG. 8(D) is an enlarged view of the reaction force generation member 22 of FIG. 8(C). In this modification as well, similarly to the second example, the reaction force generation member 22 has the body portion 22*a*, the top portion 22*b* and the base portion 22*c* (see FIG. 8(D)). However, the base portion 22*c* differs from the base portion 22*c* of the second example in that the base portion 22*c* of the second modification is designed such that the degree of varying thickness in the front-rear direction is slightly smaller than that of the second example, with the axis line Y1 of the reaction force generation member 22 being inclined toward the vertical position more than the second example in a state where the reaction force generation member 22 is fastened to the supporting portion 31*d*. More specifically, the axis line Y1 of the reaction force generation member 22 of the second modification is slightly inclined toward the direction indicated by an arrow in FIG. 8(D), compared with the second example. Because of this inclination of the axis line Y1 of the reaction force generation member 22, the second modification is designed such that the undersurface of the depression portion 11*a* comes into surface contact with the upper surface of the top portion 22*b* at the point in time when the depression portion 11*a* comes into contact with the top portion 22*b* of the reaction force generation member 22. Furthermore, the second modification is also designed such that the plane extending from the undersurface of the depression portion 11*a* includes the pivot axis C to define the plane including the pivot axis C as the plane P1. Because the configuration other than the above of the second modification is similar to that of the second example, similar parts of the second modification are given the same numbers as the second example to omit explanations about the parts.

By such a configuration, in response to a player's depression and release of the key 11, the reaction force generation member 22 operates almost similarly to the second example. In the second modification as well, however, as described above, in response to a depression of the key 11, at the point in time when the depression portion 11*a* starts coming into contact with the top portion 22*b* of the reaction force generation member 22, the undersurface of the depression portion 11*a* comes into surface contact with the upper surface of the top portion 22*b*. In this state, therefore, the axis line Y1 of the reaction force generation member 22 becomes orthogonal to the plane P1. In other words, the normal line of the undersurface of the depression portion 11*a* coincides with the axis line Y1. Resultantly, the reaction force generation member 22 starts deforming symmetrically with respect to the axis line Y1. If the key 11 is depressed further, the depression portion 11*a* keeps deforming the reaction force generation member 22 without any change in the contact position because of the friction between the undersurface of the depression portion 11*a* and the upper surface of the top portion 22*b*. At the point in time when the reaction force of the reaction force generation member 22 reaches its peak, the axis line Y1 of the reaction force generation member 22 is not orthogonal to the plane P1 nor to the undersurface of the depression portion 11*a*. At this point in time, therefore, the lower front end of the top portion 22*b* has been depressed slightly lower than the rear lower end of the top portion 22*b*.

Therefore, the deformed reaction force generation member 22 at the point in time when the reaction force has reached its peak is slightly asymmetrical with respect to the axis line Y1. However, because the asymmetry is trivial, the reaction force generation member 22 can generate a reaction force having a clear peak immediately before buckling in response to the depression of the key 11, similarly to the second example. As a result, the player can recognize a clear feeling of click immediately before the buckling, so that the second modification can provide the player with the touch of keys similar to the touch of let-off perceived on a piano. Furthermore, because the undersurface of the depression portion 11*a* comes into surface contact with the upper surface of the top portion 22*b* of the reaction force generation member 22 at the point in time when the depression portion 11*a* starts coming into contact with the top portion 22*b*, the reaction force generation member 22 starts elastically deforming in an appropriate manner in the axis line direction immediately after the start of the player's key-depression. As a result, the second modification can provide the player with favorable key touch.

The second modification is designed such that the axis line Y1 of the reaction force generation member 22 is inclined to have a certain amount of inclination angle with respect to a horizontal surface so that the undersurface of the depression portion 11*a* can be in surface contact with the upper surface of the top portion 22*b* at the point in time when the depression portion 11*a* starts coming into contact with the top portion 22*b* of the reaction force generation member 22. However, the second modification may be modified such that the inclination angle of the axis line Y1 with respect to the horizontal surface falls within a range between the inclination angle of the second example and the above-described certain amount of inclination angle. More specifically, the second modification may be modified such that the inclination angle of the axis line Y1 of the reaction force generation member 22 falls within the range between the inclination angle which allows the axis line Y1 to become orthogonal to the undersurface of the depression portion 11*a* at the point in time when the reaction force reaches its peak, and the inclination angle which allows the undersurface of the depression portion 11*a* to come into surface contact with the upper surface of the top portion 22*b* of the reaction force generation member 22 at the point in time when the depression portion 11*a* starts coming into contact with the top portion 22*b*. Since such a modification can also allow the undersurface of the depression portion 11*a* to come into surface contact with the upper surface of the top portion 22*b* immediately after the start of the contact between the depression portion 11*a* and the top portion 22*b* of the reaction force generation member 22, the modification can also expect the above-described effect.

By combining the adaptation of the inclination of the undersurface of the depression portion 11*a* according to the first modification and the adaptation of the direction of the axis line Y1 of the reaction force generation member 22 according to the second modification, the first embodiment may be further modified to allow the undersurface of the depression portion 11*a* to come into surface contact with the upper surface of the top portion 22*b* at the point in time when or immediately after the depression portion 11*a* starts coming into contact with the top portion 22*b* of the reaction force generation member 22.

In the first modification and the second modification, briefly speaking, it is preferable to configure the depression portion 11*a* of the key 11 and the reaction force generation member 22 as follows. In these modifications, assume that the direction (angle) of the normal line of the depression surface of the depression portion 11*a* with respect to the axis line Y1 of the reaction force generation member 22 before the start of a depression of the key 11 is θ1. Furthermore, assume that the direction (angle) of the normal line of the depression surface of the depression portion 11 with respect to the axis line Y1 of the reaction force generation member 22 before the start of a depression of the key 11 is θ2, the direction (angle) resulting in the normal line of the depression surface of the depression portion 11*a* being parallel to the axis line Y1 of the reaction force generation member 22 at the point in time when the reaction force of the reaction force generation member 22 reaches its peak. Furthermore, assume that the direction (angle) of the normal line of the depression surface of the depression portion 11 with respect to the axis line Y1 of the reaction force generation member 22 before the start of a depression of the key 11 is θ3, the direction (angle) resulting in the normal line of the depression surface of the depression portion 11*a* being parallel to the axis line Y1 of the reaction force generation member 22 at the start of contact between the depression portion 11*a* and the reaction force generation member 22. Then, it is preferable that the direction (angle) θ1 falls within a range between the direction (angle) θ2 and the direction (angle) θ3.

Furthermore, the second modification is designed, similarly to the second example, such that the thickness of the base portion 22*c* varies in the front-rear direction in order to incline the axis line Y1 of the reaction force generation member 22 with respect to the vertical direction. Instead of this modification, however, as in the case of the first example, the supporting portion 31*d* may be slightly inclined from the horizontal position in order to incline the axis line Y1 of the reaction force generation member 22 with respect to the vertical direction. In addition to the slight inclination of the supporting portion 31*d*, the thickness of the base portion 22*c* may be also varied in the front-rear direction. Furthermore, the second modification can be also applied to the third example.

a6. Third Modification

Figure 9:
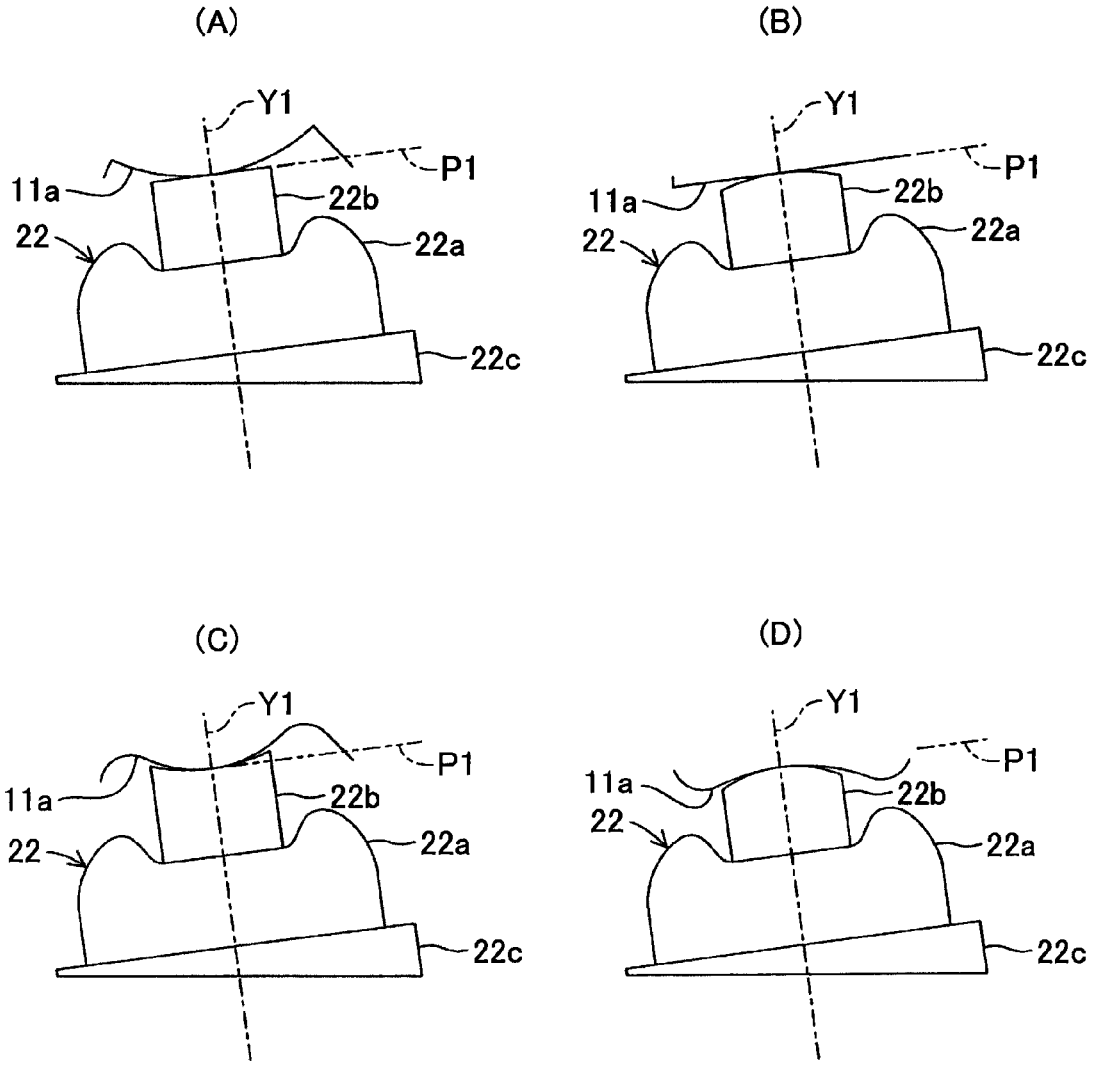
FIGS. 9(A) to (D) are schematic side views indicating examples configured such that the upper surface of a top portion of the reaction force generation member or the undersurface of a depression portion of the key is not flat.

Next, the third modification of the first embodiment will be explained. The first to third examples and the first and second modifications are designed such that the upper surface of the top portions 21*b* and 22*b* of the reaction force generation members 21 and 22, and the undersurface of the depression portion 11*a* of the key 11 are flat. However, the upper surface and the undersurface may be convex or concave. Such a modification will be explained with an example of the reaction force generation member 22. As indicated in FIG. 9(A), for instance, the upper surface of the top portion 22*b* of the reaction force generation member 22 is shaped flat, while the undersurface of the depression portion 11*a* is shaped spherical to protrude downward. As indicated in FIG. 9(B), the upper surface of the top portion 22*b* of the reaction force generation member 22 may be shaped spherical to protrude upward, with the undersurface of the depression portion 11*a* being shaped flat. As indicated in FIG. 9(C), furthermore, the upper surface of the top portion 22*b* of the reaction force generation member 22 may be shaped spherical to hollow downward, with the undersurface of the depression portion 11*a* being shaped spherical to protrude downward. As indicated in FIG. 9(D), furthermore, the upper surface of the top portion 22*b* of the reaction force generation member 22 may be shaped spherical to protrude upward, with the undersurface of the depression portion 11*a* being shaped spherical to hollow upward. Furthermore, the depression portion 11*a* may a rib be shaped like a cross, a letter H or the like protruding downward from the inner upper surface of the key 11. Such modifications can be also applied to the reaction force generation member 21.

Even in the cases where the reaction force generation members 21 and 22 are configured as indicated in FIGS. 9(A) and (B), the plane including the contact surface (a set of contact points) between the undersurface of the depression portion 11*a* and the upper surface of the top portion 21*b* and 22*b* of the reaction force generation members 21 and 22, and the pivot axis C at the point in time when the reaction force reaches its peak is defined similarly to the plane P1 of the first to third examples and the first and second modifications. In cases where the reaction force generation members 21 and 22 are configured as indicated in FIGS. 9(C) and (D), however, the plane including a part of contact points of the contact surface (a set of contact points) between the undersurface of the depression portion 11*a* and the upper surface of the top portion 21*b* and 22*b* of the reaction force generation members 21 and 22, and the pivot axis C at the point in time when the reaction force reaches its peak is defined as the plane P1 of the first to third examples. The third modification can be also applied to the second and third embodiments and their modifications which will be described later and other various applied examples which will be described later.

a7. Other Modifications

In the first to third examples and the first to third modifications, the one reaction force generation member 21 or 22 is provided for the key 11. However, the key 11 may be provided with a plurality of reaction force generation members 21 or 22. In this modification, it is necessary to coincide the timing when the respective reaction forces of the plurality of reaction force generation members 21 or 22 reach their peaks. This modification can be also applied to the second and third embodiments and their modifications which will be described later and the other various applied examples which will be described later.

In the case where the key 11 is provided with the one reaction force generation member 21 or 22, the axis line of the reaction force generation member 21 or 22 is the central axis line of the body portion 21*a* or 22*a*. In the case where the key 11 is provided with the plurality of reaction force generation members 21 or 22, however, the axis line of the reaction force generation members 21 or 22 is not simple. Therefore, the axis line will be explained. Strictly speaking, the axis line of the reaction force generation member 21 or 22 is a line of action of force, the line passing through the starting point of the reaction force vector to extend in a vector direction. In the case where the key 11 is provided with the one reaction force generation member 21 or 22, furthermore, the axis line of the reaction force generation member 21 or 22 can be defined only by paying attention only to the direction of the reaction force of the one reaction force generation member 21 or 22. In the case where the key 11 is provided with the plurality of reaction force generation members 21 or 22, however, it is necessary to define the axis line of the reaction force generation members 21 or 22 by paying attention to respective directions of the reaction forces exerted by the reaction force generation members 21 or 22. In order to define the axis line of the reaction force generation members 21 or 22, more specifically, it is necessary to obtain respective reaction force vectors of the reaction force generation members 21 or 22, to obtain the direction of the resultant force of the reaction force vectors, and to obtain the starting point around which every moment of the resultant force is zero.

b. Second Embodiment

The first embodiment has been explained as the embodiment in which the plane P1 is a plane including the depression surface (undersurface) of the depression portion 11*a* of the key 11 and the pivot axis C. The second embodiment will be explained as an embodiment in which attention will be paid to the relationship between the depression surface and the axis line Y1 of the reaction force generation member 21 or 22, including a case where the plane including the depression surface (undersurface) of the depression portion 11*a* does not include the pivot axis C.

b1. First Example

Figure 10:
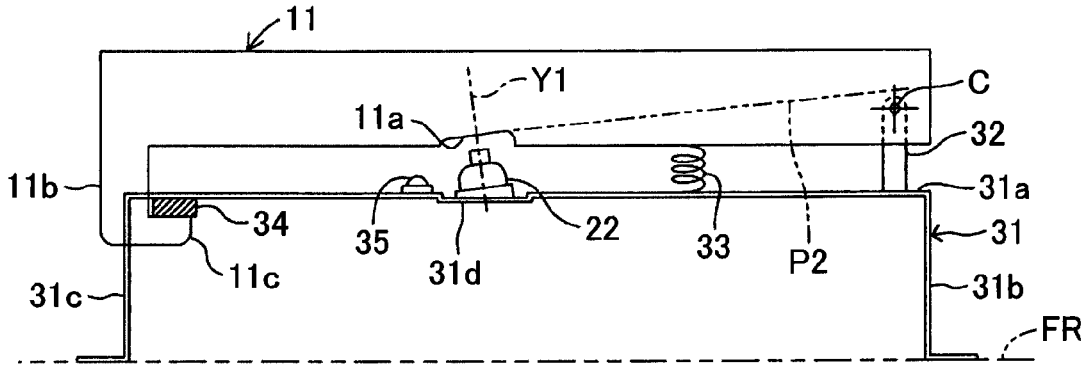
FIGS. 10(A) and (B) are schematic side views of the keyboard apparatus in a state where the key has not been depressed yet, and a state where the reaction force has reached its peak according to the first example of the second embodiment of the invention.
FIG. 10(C) is an enlarged view of the reaction force generation member in the state of (B)
Figure 10:
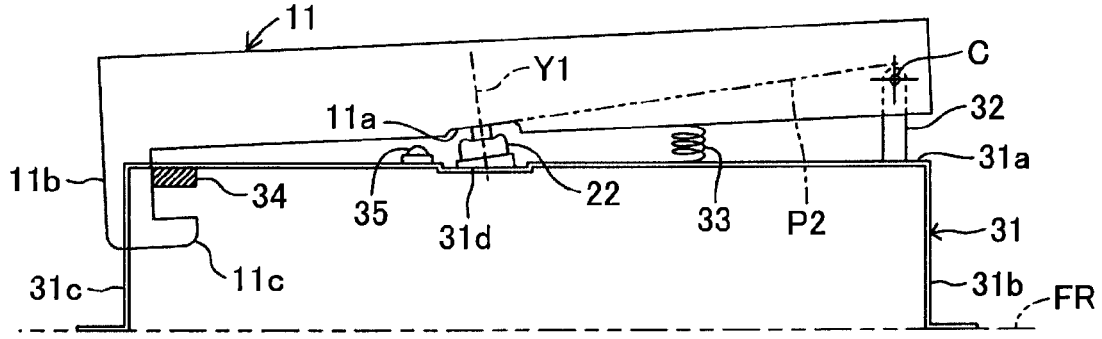
Figure 10:
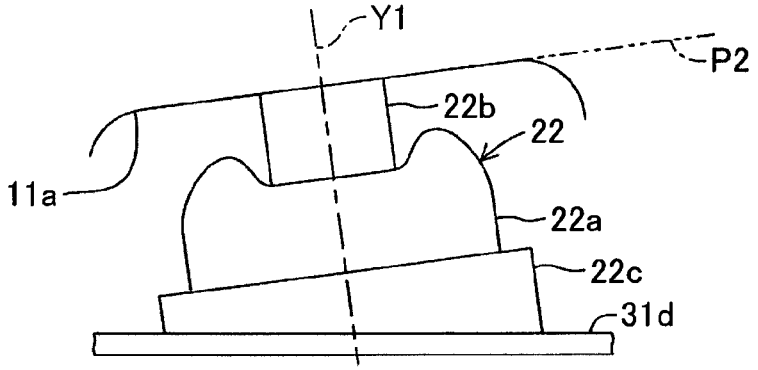

First of all, the first example of the second embodiment will be explained with reference to FIG. 10. FIG. 10(A) is a side view in which the keyboard apparatus whose key is being released (before start of a key-depression) is seen from the right. FIG. 10(B) is a side view in which the keyboard apparatus whose reaction force generation member 22 is generating a peak reaction force immediately before buckling is seen from the right. FIG. 10(C) is an enlarged view of the reaction force generation member 22 of FIG. 10(B). This keyboard apparatus is configured almost similarly to the keyboard apparatus of the second example of the first embodiment (see FIG. 5).

The reaction force generation member 22 is configured similarly to that of the second example of the first embodiment. More specifically, the base portion 22*c* gradually becomes thicker from the front toward the rear. Similarly to the second example of the first embodiment, furthermore, the supporting portion 31*d* of the key frame 31 is slightly lower than the upper surface of the upper plate portion 31*a* excluding the supporting portion 31*d*, but is situated at a horizontal position, while the undersurface of the depression portion 11*a* of the key 11 is designed such that the front side of the undersurface is slightly lower than the rear side in a state where the key is being released. However, the upper surface of the supporting portion 31*d* and the undersurface of the depression portion 11*a* are situated at positions slightly higher than the positions where the upper surface of the supporting portion 31*d* and the undersurface of the depression portion 11*a* of the second example of the first embodiment are situated. Resultantly, the axis line Y1 of the reaction force generation member 22 has the same inclination angle as that of the second example of the first embodiment, inclining slightly frontward with respect to the direction orthogonal to the supporting portion 31*d*. In this example, furthermore, a plane extending from the undersurface of the depression portion 11*a* is defined as a plane P2. Similarly to the second example of the first embodiment, furthermore, by providing adequate degree of inclination of the undersurface of the depression portion 11*a*, at the point in time when the reaction force of the reaction force generation member 22 reaches its peak by the depression of the key 11, the axis line Y1 of the reaction force generation member 22 becomes orthogonal to the plane P2. As a result, the reaction force generation member 22 of this first example is situated at a position higher than that of the second example of the first embodiment, while the plane P2 does not include the pivot axis C, so that the point of intersection of the central axis of the key supporting portions 32 and the plane P2 is situated slightly above the pivot axis C.

In other words, in this first example, the reaction force generation member 22, the depression portion 11*a* and the supporting portion 31*d* are designed to satisfy the following two conditions. The first condition is that when the reaction force exerted by the reaction force generation member 22 by the depression of the key 11 reaches its peak, the axis line Y1 of the reaction force generation member 22 becomes orthogonal to the plane P2 including the undersurface of the depression portion 11*a*, that is, that the normal line of the contact surface (identical with the above-described plane P2) between the depression portion 11*a* and the upper surface of the top portion 22*b* of the reaction force generation member 22 at the point in time when the reaction force reaches its peak becomes parallel to the axis line Y1. The second condition is that the point at which the central axis of the key supporting portions 32 intersects the plane P2 is situated above the pivot axis C. However, the amount of vertical deviation between the point of intersection and the pivot axis C is slight. In this regard, this first example of the second embodiment is different from the second example of the first embodiment. Because the configuration other than the above is similar to that of the second example of the first embodiment, similar parts of the first example of the second embodiment are given the same numbers as the second example of the first embodiment to omit explanations about the parts.

In response to a player's depression and release of the key 11, the reaction force generation member 22 of the first example configured as above operates similarly to that of the second example of the first embodiment. In response to the depression of the key 11, more specifically, the reaction force generation member 22 elastically deforms to buckle. At the point in time when the reaction force of the reaction force generation member 22 reaches its peak immediately before the buckling, the normal line of the plane P2 including the depression surface of the depression portion 11*a* becomes parallel to the axis line Y1 of the reaction force generation member 22 (see FIGS. 10(B) and (C)).

As for the first example which operates as described above, because the pivot axis C is slightly deviated from the contact surface (i.e., plane P2) between the depression portion 11*a* and the upper surface of the top portion 22*b* of the reaction force generation member 22 at the point in time when the reaction force reaches its peak, the reaction force generation member 22 deforms slightly asymmetrically with respect to the axis line Y1. Compared with the second example of the first embodiment, therefore, the first example of the second embodiment provides a slightly unclear feeling of click. However, since the normal line of the undersurface of the depression portion 11*a* at the peak of the reaction force becomes parallel to the axis line Y1 of the reaction force generation member 22 with the distance from the pivot axis C to the plane P2 being short, the player can perceive a sufficient click feeling. According to the first example, as a result, similarly to the second example of the first embodiment, in response to a depression of the key 11, the reaction force generation member 22 generates a reaction force having a clear peak immediately before buckling. Therefore, the player can recognize a clear feeling of click immediately before the buckling, so that the first example of the second embodiment can provide the player with the touch of keys similar to the touch of let-off perceived on a piano.

The first example is designed such that the normal line of the plane P2 including the depression surface of the depression portion 11*a* of the key 11 at the point in time when the reaction force of the reaction force generation member 22 reaches its peak becomes parallel to the axis line Y1 of the reaction force generation member 22. In the case of the first example, however, similarly to the second example of the first embodiment, the angle for which the key 11 pivots from the state where the depression portion 11*a* starts coming into contact with the top portion 22*b* of the reaction force generation member 22 to the state where the depression portion 11*a* finishes depressing the reaction force generation member 22 is small. In this example as well, therefore, the key 11 and the reaction force generation member 22 may be configured such that the direction of the axis line Y1 of the reaction force generation member 22 exists within an angle between the normal line of the depression surface of the depression portion 11*a* at the point in time when the depression portion 11*a* comes into contact with the top portion 22*b* and the normal line of the depression surface of the depression portion 11*a* at the point in time when the depression portion 11*a* finishes depressing the reaction force generation member 22. This modification can be also applied to the second to fourth examples of the second embodiment which will be explained later.

b2. Second Example

Figure 11:
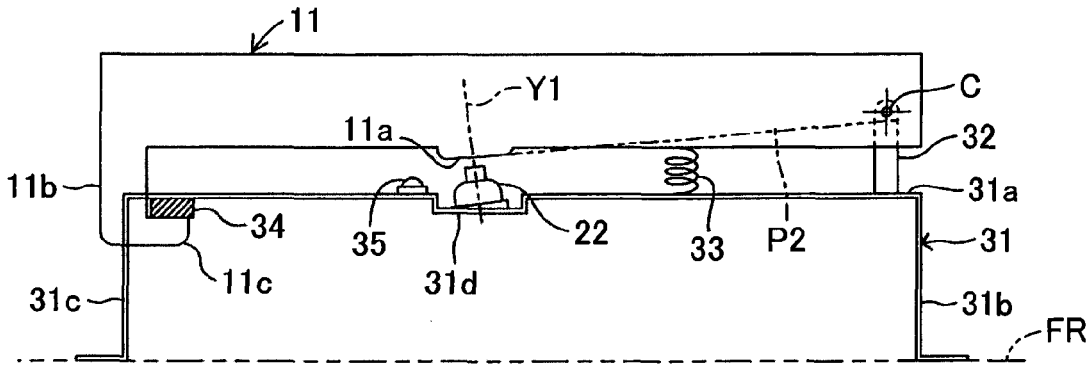
FIGS. 11(A) and (B) are schematic side views of the keyboard apparatus in a state where the key has not been depressed yet, and a state where the reaction force has reached its peak according to the second example of the second embodiment of the invention.
FIG. 11(C) is an enlarged view of the reaction force generation member in the state of (B)
Figure 11:
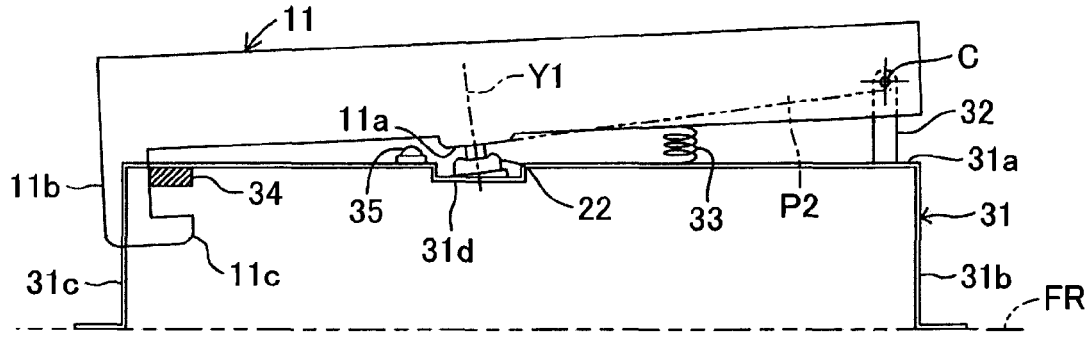
Figure 11:
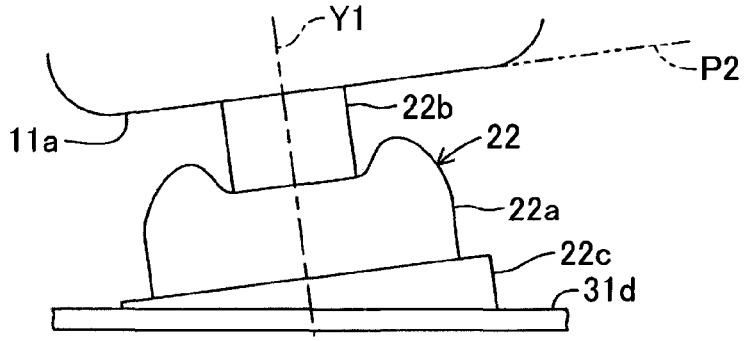

Next, the second example of the second embodiment of the invention will be explained with reference to FIG. 11. FIG. 11(A) is a side view in which the keyboard apparatus whose key is being released (before start of a key-depression) is seen from the right. FIG. 11(B) is a side view in which the keyboard apparatus whose reaction force generation member 22 is generating a peak reaction force immediately before buckling is seen from the right. FIG. 11(C) is an enlarged view of the reaction force generation member 22 of FIG. 11(B). This keyboard apparatus is also configured almost similarly to the keyboard apparatus of the second example of the first embodiment (see FIG. 5).

The reaction force generation member 22 is configured similarly to that of the second example of the first embodiment. More specifically, the base portion 22*c* gradually becomes thicker from the front toward the rear. Similarly to the second example of the first embodiment, furthermore, the supporting portion 31*d* of the key frame 31 is slightly lower than the upper surface of the upper plate portion 31*a* excluding the supporting portion 31*d*, but is situated at a horizontal position, while the undersurface of the depression portion 11*a* of the key 11 is designed such that the front side of the undersurface is slightly lower than the rear side in a state where the key is being released. However, the undersurface of the supporting portion 31*d* is situated at a position slightly lower than the position where the undersurface of the supporting portion 31*d* of the second example of the first embodiment is situated. Furthermore, the depression portion 11*a* protrudes downward from the undersurface of the key 11. Resultantly, the axis line Y1 of the reaction force generation member 22 has the same inclination angle as that of the second example of the first embodiment, slightly inclining frontward with respect to the direction orthogonal to the supporting portion 31*d*. In this example as well, furthermore, the plane extending from the undersurface of the depression portion 11*a* is defined as the plane P2. Similarly to the second example of the first embodiment, furthermore, by providing adequate degree of inclination of the undersurface of the depression portion 11*a*, at the point in time when the reaction force of the reaction force generation member 22 reaches its peak by the depression of the key 11, the axis line Y1 of the reaction force generation member 22 becomes orthogonal to the plane P2. In this second example, as a result, the reaction force generation member 22 is situated at a position lower than that of the second example of the first embodiment, while the plane P2 does not include the pivot axis C, so that the point of intersection of the central axis of the key supporting portion 32 and the plane P2 is situated slightly below the pivot axis C.

In other words, in the second example, the reaction force generation member 22, the depression portion 11*a* and the supporting portion 31*d* are designed to satisfy the following two conditions. The first condition is that when the reaction force exerted by the reaction force generation member 22 by the depression of the key 11 reaches its peak, the axis line Y1 of the reaction force generation member 22 becomes orthogonal to the plane P2 including the undersurface of the depression portion 11*a*, that is, that the normal line of the contact surface (identical with the above-described plane P2) between the depression portion 11*a* and the upper surface of the top portion 22*b* of the reaction force generation member 22 at the point in time when the reaction force reaches its peak becomes parallel to the axis line Y1. The second condition is that the point at which the central axis of the key supporting portions 32 intersects the plane P2 is situated below the pivot axis C. In this case as well, however, the amount of vertical deviation between the point of intersection and the pivot axis C is slight. In this regard, the second example of the second embodiment is different from the second example of the first embodiment. Because the configuration other than the above is similar to that of the second example of the first embodiment, similar parts of the second example of the second embodiment are given the same numbers as the second example of the first embodiment to omit explanations about the parts.

In response to a player's depression and release of the key 11, the reaction force generation member 22 of the second example configured as above operates similarly to that of the second example of the first embodiment. In response to the depression of the key 11, more specifically, the reaction force generation member 22 elastically deforms to buckle. At the point in time when the reaction force of the reaction force generation member 22 reaches its peak immediately before buckling, the normal line of the plane P2 including the depression surface of the depression portion 11*a* becomes parallel to the axis line Y1 of the reaction force generation member 22 (see FIGS. 11(B) and (C)).

As for the second example as well which operates as described above, because the pivot axis C is slightly deviated from the contact surface (i.e., the plane P2) between the depression portion 11*a* and the upper surface of the top portion 22*b* of the reaction force generation member 22 at the point in time when the reaction force reaches its peak, the reaction force generation member 22 deforms slightly asymmetrically with respect to the axis line Y1. Compared with the second example of the first embodiment, therefore, the second example of the second embodiment provides a slightly unclear feeling of click. However, since the normal line of the undersurface of the depression portion 11*a* at the peak of the reaction force becomes parallel to the axis line Y1 of the reaction force generation member 22 with the distance from the pivot axis C to the plane P2 being short, the player can perceive a sufficient click feeling. According to the second example as well, as a result, similarly to the second example of the first embodiment, in response to a depression of the key 11, the reaction force generation member 22 generates a reaction force having a clear peak immediately before buckling. Therefore, the player can recognize a clear feeling of click immediately before the buckling, so that the second example of the second embodiment can provide the player with the touch of keys similar to the touch of let-off perceived on a piano.

b3. Third Example

Figure 12:
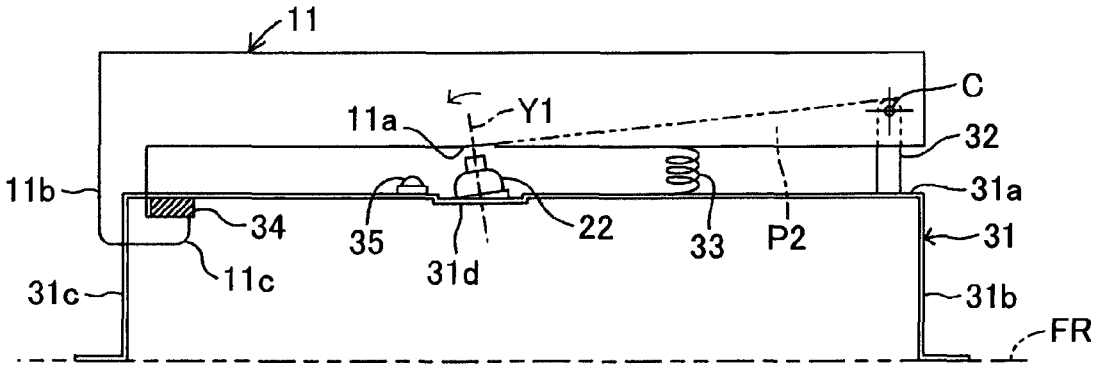
FIGS. 12(A) and (B) are schematic side views of the keyboard apparatus in a state where the key has not been depressed yet, and a state where the reaction force has reached its peak according to the third example of the second embodiment of the invention.
FIG. 12(C) is an enlarged view of the reaction force generation member in the state of (B)
Figure 12:
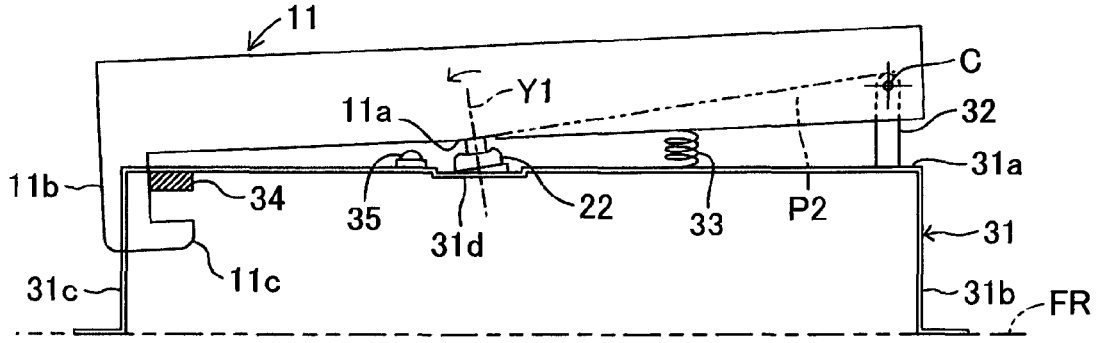
Figure 12:
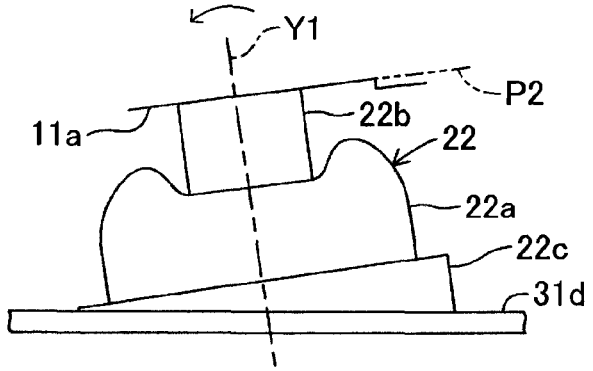

Next, the third example of the second embodiment of the invention will be explained with reference to FIG. 12. FIG. 12(A) is a side view in which the keyboard apparatus whose key is being released (before start of a key-depression) is seen from the right. FIG. 12(B) is a side view in which the keyboard apparatus whose reaction force generation member 22 is generating a peak reaction force immediately before buckling is seen from the right. FIG. 12(C) is an enlarged view of the reaction force generation member 22 of FIG. 12(B). This keyboard apparatus is also configured almost similarly to the keyboard apparatus of the second example of the first embodiment (see FIG. 5).

The reaction force generation member 22 is configured almost similarly to that of the second example of the first embodiment. More specifically, although the base portion 22*c* gradually becomes thicker from the front toward the rear, the change in thickness of the base portion 22*c* is very slightly greater than the second example of the first embodiment. Similarly to the second example of the first embodiment, furthermore, the supporting portion 31*d* of the key frame 31 is slightly lower than the upper surface excluding the supporting portion 31*d* of the upper plate portion 31*a*, but is situated at a horizontal position, while the undersurface of the depression portion 11*a* of the key 11 is designed such that the front side of the undersurface is slightly lower than the rear side in a state where the key is being released. Resultantly, the axis line Y1 of the reaction force generation member 22 is inclined toward an arrow indicated in the figure so that the axis line Y1 can have a greater angle with respect to the vertical direction than the second example of the first embodiment. In this example as well, furthermore, the plane extending from the undersurface of the depression portion 11*a* is defined as the plane P2. Similarly to the second example of the first embodiment, furthermore, by providing adequate degree of inclination of the undersurface of the depression portion 11*a*, at the point in time when the reaction force of the reaction force generation member 22 by the depression of the key 11 reaches its peak, the axis line Y1 of the reaction force generation member 22 becomes orthogonal to the plane P2. In the third example, as a result, the angle between the plane P2 and the horizontal surface is great, while the plane P2 does not include the pivot axis C, so that the point of intersection of the central axis of the key supporting portions 32 and the plane P2 is situated slightly above the pivot axis C.

In other words, in the third example, the reaction force generation member 22, the depression portion 11*a* and the supporting portion 31*d* are designed to satisfy the following two conditions. The first condition is that when the reaction force exerted by the reaction force generation member 22 by the depression of the key 11 reaches its peak, the axis line Y1 of the reaction force generation member 22 becomes orthogonal to the plane P2 including the undersurface of the depression portion 11*a*, that is, that the normal line of the contact surface (identical with the above-described plane P2) between the depression portion 11*a* and the upper surface of the top portion 22*b* of the reaction force generation member 22 at the point in time when the reaction force reaches its peak becomes parallel to the axis line Y1. The second condition is that the point at which the central axis of the key supporting portions 32 intersects the plane P2 is situated above the pivot axis C. In this case as well, however, the amount of vertical deviation between the point of intersection and the pivot axis C is slight. In this regard, the third example of the second embodiment is different from the second example of the first embodiment. Because the configuration other than the above is similar to that of the second example of the first embodiment, similar parts of the third example of the second embodiment are given the same numbers as the second example of the first embodiment to omit explanations about the parts.

In response to a player's depression and release of the key 11, the reaction force generation member 22 of the third example configured as above operates similarly to that of the second example of the first embodiment. In response to the depression of the key 11, more specifically, the reaction force generation member 22 elastically deforms to buckle. At the point in time when the reaction force of the reaction force generation member 22 reaches its peak immediately before buckling, the normal line of the plane P2 including the depression surface of the depression portion 11*a* becomes parallel to the axis line Y1 of the reaction force generation member 22 (see FIGS. 12(B) and (C)).

As for the third example as well which operates as described above, because the pivot axis C is slightly deviated from the contact surface (i.e., the plane P2) between the depression portion 11*a* and the upper surface of the top portion 22*b* of the reaction force generation member 22 at the point in time when the reaction force reaches its peak, the reaction force generation member 22 deforms slightly asymmetrically with respect to the axis line Y1. Compared with the second example of the first embodiment, therefore, the third example of the second embodiment provides a slightly unclear feeling of click. However, since the normal line of the undersurface of the depression portion 11*a* at the peak of the reaction force becomes parallel to the axis line Y1 of the reaction force generation member 22 with the distance from the pivot axis C to the plane P2 being short, the player can perceive a sufficient click feeling. According to the third example as well, as a result, similarly to the second example of the first embodiment, in response to a depression of the key 11, the reaction force generation member 22 generates a reaction force having a clear peak immediately before buckling. Therefore, the player can recognize a clear feeling of click immediately before the buckling, so that the third example of the second embodiment can provide the player with the touch of keys similar to the touch of let-off perceived on a piano.

b4. Fourth Example

Figure 13:
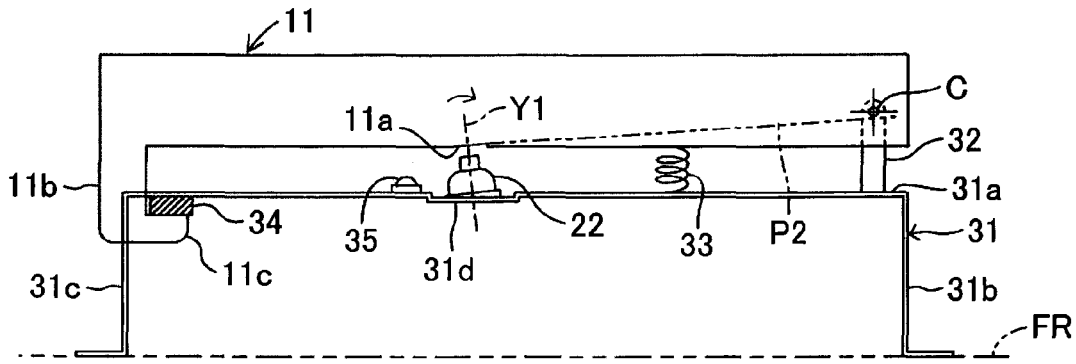
FIGS. 13(A) and (B) are schematic side views of the keyboard apparatus in a state where the key has not been depressed yet, and a state where the reaction force has reached its peak according to the fourth example of the second embodiment of the invention.
FIG. 13(C) is an enlarged view of the reaction force generation member in the state of (B)
Figure 13:
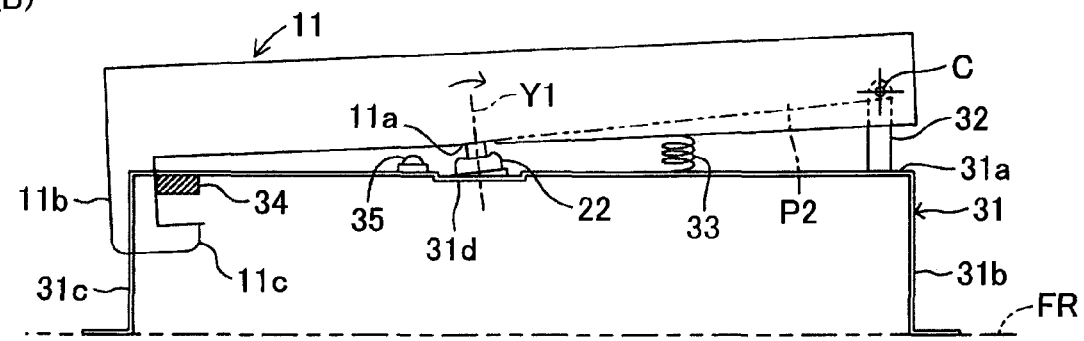
Figure 13:
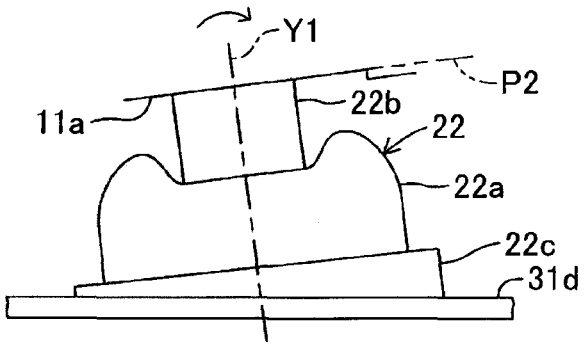

Next, the fourth example of the second embodiment of the invention will be explained with reference to FIG. 13. FIG. 13(A) is a side view in which the keyboard apparatus whose key is being released (before start of a key-depression) is seen from the right. FIG. 13(B) is a side view in which the keyboard apparatus whose reaction force generation member 22 is generating a peak reaction force immediately before buckling is seen from the right. FIG. 13(C) is an enlarged view of the reaction force generation member 22 of FIG. 13(B). This keyboard apparatus is also configured almost similarly to the keyboard apparatus of the second example of the first embodiment (see FIG. 5).

The reaction force generation member 22 is configured almost similarly to the second example of the first embodiment. More specifically, although the base portion 22*c* gradually becomes thicker from the front toward the rear, the change in thickness of the base portion 22*c* is very slightly smaller than the second example of the first embodiment. Similarly to the second example of the first embodiment, furthermore, the supporting portion 31*d* of the key frame 31 is slightly lower than the upper surface excluding the supporting portion 31*d* of the upper plate portion 31*a*, but is situated at a horizontal position, while the undersurface of the depression portion 11*a* of the key 11 is configured such that the front side of the undersurface is slightly lower than the rear side in a state where the key is being released. Resultantly, the axis line Y1 of the reaction force generation member 22 is inclined toward an arrow indicated in the figure so that the axis line Y1 can have a smaller angle with respect to the vertical direction than the second example of the first embodiment. In this example as well, furthermore, the plane extending from the undersurface of the depression portion 11*a* is defined as the plane P2. Similarly to the second example of the first embodiment, furthermore, by providing adequate degree of inclination of the undersurface of the depression portion 11*a*, at the point in time when the reaction force of the reaction force generation member 22 by the depression of the depression portion 11*a* reaches its peak, the axis line Y1 of the reaction force generation member 22 becomes orthogonal to the plane P2. In the fourth example, as a result, the angle between the plane P2 and the horizontal surface is small, while the plane P2 does not include the pivot axis C, so that the point of intersection of the central axis of the key supporting portions 32 and the plane P2 is situated slightly below the pivot axis C.

In other words, in the fourth example, the reaction force generation member 22, the depression portion 11*a* and the supporting portion 31*d* are designed to satisfy the following two conditions. The first condition is that when the reaction force exerted by the reaction force generation member 22 by the depression of the key 11 reaches its peak, the axis line Y1 of the reaction force generation member 22 becomes orthogonal to the plane P2 including the undersurface of the depression portion 11*a*, that is, that the normal line of the contact surface (identical with the above-described plane P2) between the depression portion 11*a* and the upper surface of the top portion 22*b* of the reaction force generation member 22 at the point in time when the reaction force reaches its peak becomes parallel to the axis line Y1. The second condition is that the point at which the central axis of the key supporting portions 32 intersects the plane P2 is situated below the pivot axis C. In this example as well, however, the amount of vertical deviation between the point of intersection and the pivot axis C is slight. In this regard, the fourth example of the second embodiment is different from the second example of the first embodiment. Because the configuration other than the above is similar to that of the second example of the first embodiment, similar parts of the fourth example of the second embodiment are given the same numbers as the second example of the first embodiment to omit explanations about the parts.

In response to a player's depression and release of the key 11, the reaction force generation member 22 of the fourth example configured as above operates similarly to that of the second example of the first embodiment. In response to the depression of the key 11, more specifically, the reaction force generation member 22 elastically deforms to buckle. At the point in time when the reaction force of the reaction force generation member 22 reaches its peak immediately before buckling, the normal line of the plane P2 including the depression surface of the depression portion 11*a* becomes parallel to the axis line Y1 of the reaction force generation member 22 (see FIGS. 13(B) and (C)).

As for the fourth example as well which operates as described above, because the pivot axis C is slightly deviated from the contact surface (i.e., plane P2) between the depression portion 11*a* and the upper surface of the top portion 22*b* of the reaction force generation member 22 at the point in time when the reaction force reaches its peak, the reaction force generation member 22 deforms slightly asymmetrically with respect to the axis line. Compared with the second example of the first embodiment, therefore, the fourth example of the second embodiment provides a slightly unclear feeling of click. However, since the normal line of the undersurface of the depression portion 11*a* at the peak of the reaction force becomes parallel to the axis line Y1 of the reaction force generation member 22 with the distance from the pivot axis C to the plane P2 being short, the player can perceive a sufficient click feeling. According to the fourth example as well, as a result, similarly to the second example of the first embodiment, in response to a depression of the key 11, the reaction force generation member 22 generates a reaction force having a clear peak immediately before buckling. Therefore, the player can recognize a clear feeling of click immediately before the buckling, so that the fourth example of the second embodiment can provide the player with the touch of keys similar to the touch of let-off perceived on a piano.

b5. Modifications

Next, modifications of the first to fourth examples of the second embodiment will be explained. The first to fourth examples are configured almost similarly to the second example of the first embodiment. Similarly to the first example of the first embodiment, however, the first to fourth examples may be configured such that as the reaction force generation member, the reaction force generation member 21 having the base portion 21*c* having the even thickness of the first example of the first embodiment is used, with the supporting portion of the upper plate portion 31*a* of the key frame 31 being inclined like the supporting portion 31*d* of the first embodiment in order to incline the axis line Y1 of the reaction force generation member. In addition to the base portion 21*c* having the thickness which varies in the front-rear direction, furthermore, the upper surface of the supporting portion 31*d* may be inclined so that the axis line Y1 of the reaction force generation member can tilt. Furthermore, the keyboard apparatus according to the first to fourth examples of the second embodiment may be configured similarly to the third example of the first embodiment having the pivot axis C situated close to the upper plate portion 31*a* of the key frame 31.

Furthermore, the first to fourth examples of the second embodiment may be configured, similarly to the first and second modifications of the first example of the first embodiment, such that at the point in time when the key 11 is depressed to make the depression portion 11*a* start coming into contact with the top portion 21*b* or 22*b* of the reaction force generation member 21 or 22, the undersurface of the depression portion 11*a* comes into surface contact with the upper surface of the top portion 21*b* or 22*b*. Furthermore, the depression portion 11*a* or the reaction force generation member 21 or 22 of the first to fourth examples of the second embodiment may be configured, as FIGS. 9(A) and (B) of the third modification of the first example of the first embodiment, such that the undersurface of the depression portion 11*a* of the key 11 or the upper surface of the top portion 21*b* or 22*b* of the reaction force generation member 21 or 22 is not flat. Similarly to the fourth modification of the first example of the first embodiment, furthermore, the first to fourth examples of the second embodiment may be configured to have a plurality of reaction force generation members 21 or 22.

b6. Relationship with the First Embodiment

The first to fourth examples of the second embodiment were explained as examples whose pivot axis C slightly deviates from the plane P2 extending from the undersurface of the depression portion 11*a*. However, if the first to fourth examples of the second embodiment as well are configured such that the amount of deviation between the pivot axis C and the plane P2, that is, the amount of deviation between the point at which the central axis of the key supporting portions 32 intersects the plane P2 and the pivot axis C is quite small, the keyboard apparatuses according to the first to fourth examples of the second embodiment are quite close to the keyboard apparatuses according to the first to third examples of the first embodiment. If the amount of deviation is "0", particularly, the keyboard apparatuses according to the first to fourth examples of the second embodiment are the same as the keyboard apparatuses according to the first to third examples of the first embodiment. The keyboard apparatuses according to the second embodiment and its modifications do not exclude the keyboard apparatuses according to the first to third examples of the first embodiment.

Furthermore, it was explained in the first embodiment that the key 11 and the reaction force generation member 21 may be configured such that the direction of the axis line Y1 of the reaction force generation member 21 falls within the angle between the normal line of the plane including the pivot axis C and the depression point of the depression portion 11*a* at the point in time when the depression portion 11*a* comes into contact with the top portion 21*b*, and the normal line of the plane including the pivot axis C and the depression point of the depression portion 11*a* at the point in time when the depression portion 11*a* finishes depressing the reaction force generation member 21. Furthermore, it was explained in the second embodiment that the key 11 and the reaction force generation member 21 may be configured such that the direction of the axis line Y1 of the reaction force generation member 22 falls within the angle between the normal line of the depression portion 11*a* at the point in time when the depression portion 11*a* comes into contact with the top portion 22*b* and the normal line of the depression surface of the depression portion 11*a* at the point in time when the depression portion 11*a* finishes depressing the reaction force generation member 22. As for the second embodiment, therefore, in a case where the depression surface (undersurface) of the depression portion 11*a* includes the pivot axis C, the keyboard apparatus of the second embodiment can be identical with the keyboard apparatus of the first embodiment.

c. Third Embodiment

Figure 14:
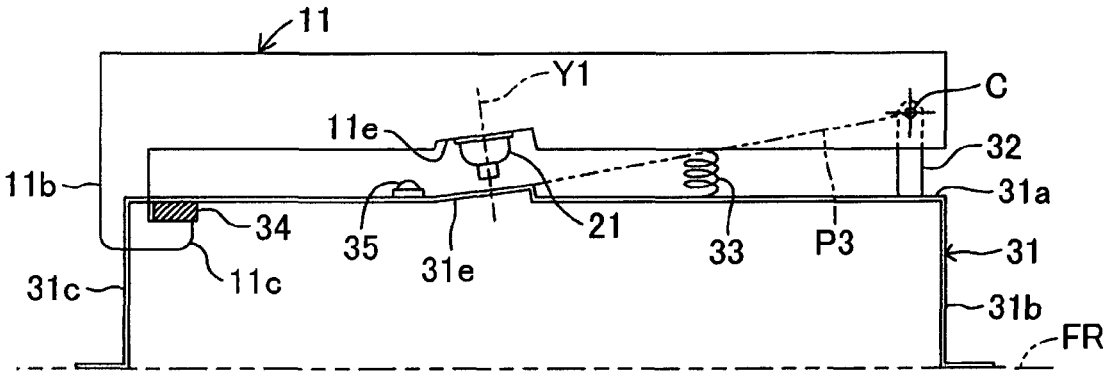
FIG. 14 is a schematic side view of the keyboard apparatus according to the third embodiment of the invention.
Figure 14:
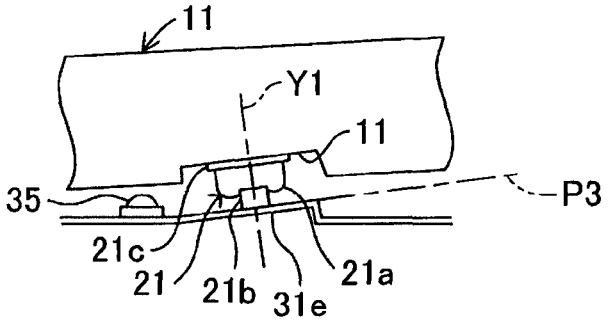

The first and second embodiments and their modifications are configured such that the key 11 is provided with the depression portion 11*a*, while the reaction force generation member 21 or 22 is fastened to the supporting portion 31*d* of the upper plate portion 31*a* of the key frame 31. By the depression of the key 11, therefore, the top portion 21*b* or 22*b* of the reaction force generation member 21 or 22 is depressed by the depression portion 11*a*. Instead of such a configuration, however, the third embodiment which will be explained next is configured such that the reaction force generation member 21 or 22 is provided on the key 11. FIG. 14 indicates a modification of the first example of the first embodiment. FIG. 14(A) is a side view in which the keyboard apparatus of the third embodiment whose key is being released (before start of a key-depression) is seen from the right. FIG. 14(B) is an enlarged view of the reaction force generation member 21 which is in a state where the reaction force generating member 21 is generating a peak reaction force immediately before buckling.

The keyboard apparatus of the third embodiment is configured such that a supporting portion 11*e* is provided on the undersurface of the central portion of the key 11 while the reaction force generation member 21 which is the same as that of the first example of the first embodiment is fastened to the supporting portion 11*e*. The axis line Y1 of the reaction force generation member 21 is the same as that of the first example of the first embodiment. The supporting portion 11*e* is configured to be flat and to have the front side which is slightly lower than the rear side in a state where the key is being released. In the third embodiment, furthermore, at a position situated on the upper plate portion 31*a* of the key frame 31 to be opposed to the reaction force generation member 21, a flat depression portion 31*e* is provided. The depression portion 31*e* is inclined such that the front side is lower than the rear side. The inclination angle of the upper surface of the depression portion 31*e* is designed such that a plane extending from the upper surface of the depression portion 31*e* includes the pivot axis C. The plane including the pivot axis C is referred to as a plane P3. Similarly to the first example of the first embodiment, furthermore, by providing adequate degree of inclination of the upper surface of the depression portion 31*e*, at the point in time when the reaction force of the reaction force generation member 22 by the depression of the key 11 reaches its peak, the axis line Y1 of the reaction force generation member 22 becomes orthogonal to the plane P3. Because the configuration other than the above is similar to that of the first example of the first embodiment, similar parts of the third embodiment are given the same numbers as the first example of the first embodiment to omit explanations about the parts.

In response to the player's depression and release of the key 11, the third embodiment configured as above also operates such that the undersurface of the top portion 21*b* of the reaction force generation member 21 comes into contact with the depression portion 31*e*, so that the reaction force generation member 21 elastically deforms to buckle. However, the third embodiment is different from the first example of the first embodiment in that the depression portion 31*e* is stationary, but the reaction force generation member 21 moves along with the key-depression. Except the difference, the third embodiment is similar to the first example of the first embodiment. At the point in time when the reaction force of the reaction force generation member 21 reaches its peak immediately before buckling, the normal line of the plane P3 including the pivot axis C and the depression point (depression surface) of the depression portion 31*e* becomes parallel to the axis line Y1 of the reaction force generation member 21 (see FIG. 14(B)). Similarly to the case of the first example of the first embodiment, as a result, the third embodiment can also allow the reaction force generation member 21 to generate reaction force having a clear peak immediately before buckling in response to the depression of the key 11. As a result, the player can recognize a clear feeling of click immediately before the buckling, so that the third embodiment can provide the player with the touch of keys similar to the touch of let-off perceived on a piano.

The above-described configuration in which the reaction force generation member 21 is provided on the key 11, with the depression portion 31*e* being provided on the key frame 31 can be also applied to the second and third examples of the first embodiment, and the first to fourth examples of the second embodiment. In such cases as well, the reaction force generation member 21 or 22 are to be provided on the key 11, while the flat depression portion 31*e* is to be provided at a position situated on the upper plate portion 31*a* of the key frame 31 to be opposed to the reaction force generation member 21 or 22. In the case where the configuration is applied to the second and third examples of the first embodiment, furthermore, the second and third examples of the first embodiment are to be configured such that when the reaction force reaches its peak, the axis line Y1 of the reaction force generation member 21 or 22 becomes orthogonal to the upper surface of the depression portion 31*e*, that is, the plane P3 including the pivot axis C. In the case where the configuration is applied to the first to fourth examples of the second embodiment, furthermore, the first to fourth examples of the second embodiment are to be configured such that when the reaction force reaches its peak, the axis line Y1 of the reaction force generation member 22 becomes orthogonal to the upper surface of the depression portion 31*e*, that is, the plane P3 which does not include the pivot axis C.

d. Other Applied Examples of the Invention

In the first to third examples of the first embodiment, the first to fourth examples of the second embodiment, the third embodiment, and the modifications thereof, the present invention is applied to the keyboard apparatus, while by the contact between the key 11 and the reaction force generation member 21 or 22, the reaction force generation member 21 or 22 generates a reaction force against a key-depression. Instead of such a configuration, however, the reaction force generation member 21 or 22 may generate a reaction force against a key-depression by the contact between a different member indirectly driven by the key 11 and the reaction force generation member 21 or 22. Furthermore, the apparatus which generates a reaction force by use of the reaction force generation member 21 or 22 according to the invention may be applied to operating element devices other than the keyboard apparatus. Next, such applied examples of the present invention will be explained.

d1. First Applied Example

Figure 15:
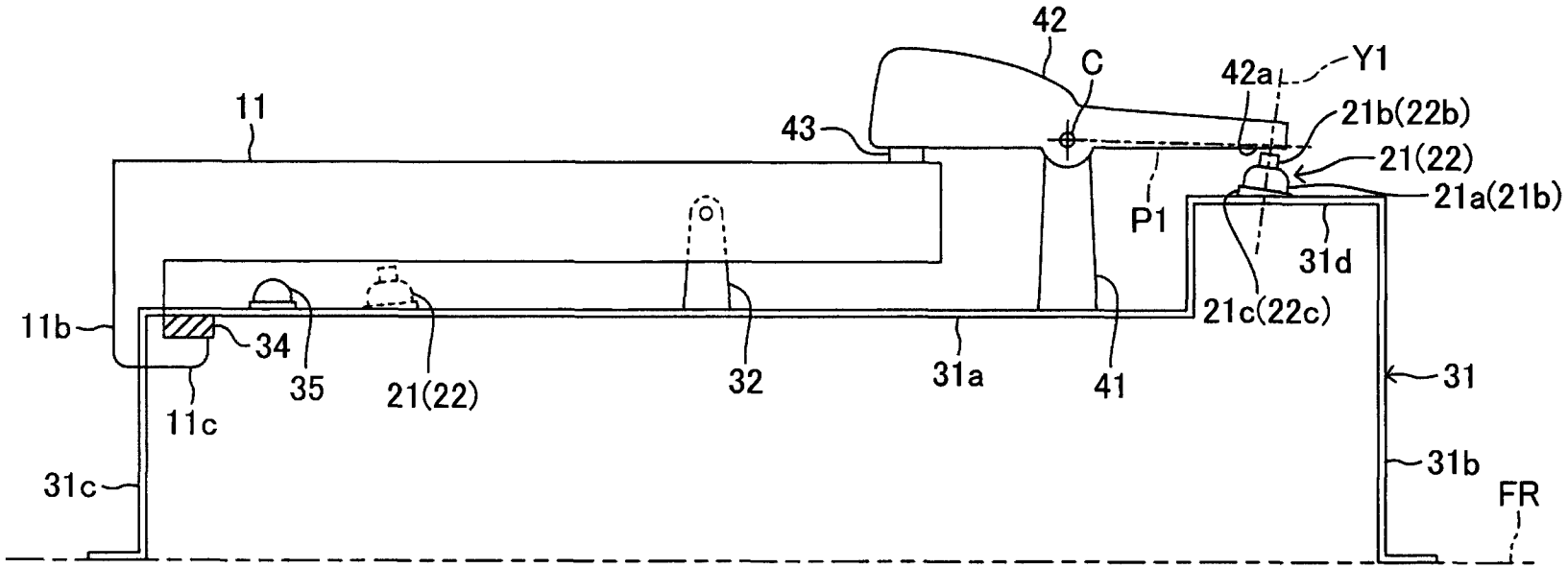
FIG. 15 is a schematic side view of the keyboard apparatus according to the first applied example of the invention.

A keyboard apparatus of the first applied example having a mass body 42 which pivots above the key 11 in response to a player's manipulation of the key 11 will be explained with reference to a drawing. FIG. 15 is a side view in which the keyboard apparatus of the first applied example is seen from the right. The keyboard apparatus has the key 11 configured almost similarly to that of the first to third embodiments. The key 11 is supported on the upper plate portion 31*a* of the key frame 31 so that the key 11 can pivot through the key supporting portions 32. In this applied example, the key supporting portions 32 are provided not at the rear end but at the middle portion of the key 11. Furthermore, the keyboard apparatus has the stopper member 34 and the key switch 35 configured almost similarly to those of the first to third embodiments.

Furthermore, the keyboard apparatus has the mass body 42 supported by a supporting member 41 so that the mass body 42 can pivot. The supporting member 41 is erected on the upper plate portion 31*a* such that the supporting member 41 is situated behind the rear end of the key 11. The mass body 42 is long in the front-rear direction, and has a middle portion supported by the supporting member 41 so that the mass body 42 can pivot about the pivot axis C. More specifically, a front portion and a rear portion of the mass body 42 pivot upward and downward. The mass body 42 is heavier in the front side than in the rear side, while the rear portion located behind the pivot axis C extends linearly rearward. To the upper surface of the rear end portion of the key 11, a shock absorbing member 43 is fastened, so that the undersurface of the front portion of the mass body 42 urges the rear end portion of the key 11 downward through the shock absorbing member 43. Since the rear end portion of the key 11 is urged downward, the front end portion of the key 11 is urged upward to be kept roughly horizontal because of the engagement of the engagement portion 11*c* with the stopper member 34 in a state where the key 11 is being released.

The upper plate portion 31*a* has the supporting portion 31*d* configured such that the rear portion thereof is raised stepwise. To the supporting portion 13*d*, the reaction force generation member 21 (22) similar to that of the first embodiment is fastened. The axis line Y1 of the reaction force generation member 21 (22) is inclined to slightly deviate from the vertical direction with respect to the supporting portion 31*d*. The undersurface of the linearly extending rear portion of the mass body 42 serves as a flat depression portion 42*a* which faces the upper surface of the top portion 21*b* (22*b*) of the reaction force generation member 21 (22) in a state where the key is being released. When the key is depressed, the depression portion 42*a* is displaced downward to come into contact with the upper surface of the top portion 21*b* (22*b*) to depress the reaction force generation member 21 (22). In this example as well, the reaction force generation member 21 (22) is elastically deformed by the depression. At the point in time when the reaction force reaches its peak, as a result, the axis line Y1 of the reaction force generation member 21 (22) becomes orthogonal to the plane P1 (the contact surface between the undersurface of the depression portion 42*a* and the upper surface of the top portion 21*b* (22*b*)) extending from the undersurface of the depression portion 42*a* to include the pivot axis C. In other words, the normal line of the plane P1 becomes parallel to the axis line Y1.

According to the first applied example configured as above, when the key 11 is depressed, the mass body 42 pivots in a clockwise direction, so that the reaction force generation member 21 (22) is depressed by the depression portion 42*a* of the mass body 42 to elastically deform to buckle. When the key 11 is released, the mass body 42 pivots in a counterclockwise direction, so that the key 11 returns to the roughly horizontal state because of the engagement of the engagement portion 11*c* with the stopper member 34. When the key is depressed as described above, at the point in time when the reaction force of the reaction force generation member 21 (22) reaches its peak immediately before buckling, the normal line of the plane P1 becomes parallel to the axis line Y1 of the reaction force generation member 21 (22). According to the first applied example as well, as a result, similarly to the first embodiment, in response to a depression of the key 11, the reaction force generation member 21 (22) generates a reaction force having a clear peak immediately before buckling. Therefore, the player can recognize a clear feeling of click immediately before the buckling, so that the first applied example can provide the player with the touch of keys similar to the touch of let-off perceived on a piano.

Similarly to the first embodiment, furthermore, the keyboard apparatus having the mass body 42 may be configured such that the reaction force generation member 21 (22) is provided below the key 11 so that the reaction force generation member 21 (22) is situated on the upper surface of the upper plate portion 31*a* of the key frame 31 (see broken lines in the figure).

In the first applied example as well, furthermore, the mass body 42 and the reaction force generation member 21 (22) may be configured such that the direction of the axis line Y1 of the reaction force generation member 21 (22) exists within an angle between the normal line of the plane including the pivot axis C and the depression point of the depression portion 11*a* at the point in time when the depression portion 42*a* of the mass body 42 comes into contact with the top portion 21*b* (22*b*) of the reaction force generation member 21 (22), and the normal line of the plane including the pivot axis C and the depression point of the depression portion 42*a* at the point in time when the depression portion 42*a* finishes depressing the reaction force generation member 21 (22).

d2. Second Applied Example

Figure 16:
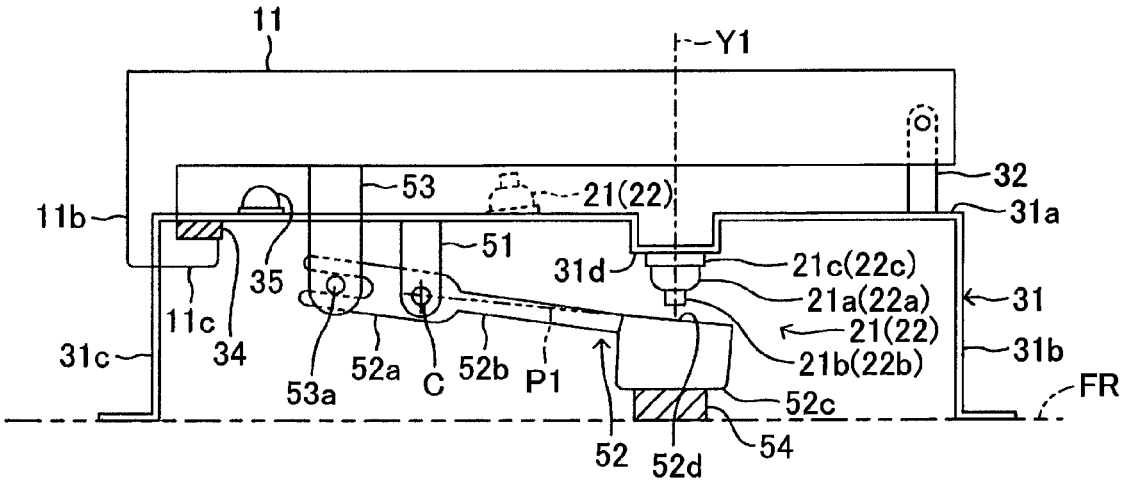
FIG. 16 is a schematic side view of the keyboard apparatus according to the second applied example of the invention.

Next, a keyboard apparatus of the second applied example having a hammer 52 which pivots below the key 11 in response to a player's manipulation of the key 11 will be explained with reference to a drawing. FIG. 16 is a side view in which the keyboard apparatus of the second applied example is seen from the right. The keyboard apparatus also has the key 11 configured almost similarly to that of the first to third embodiments. The key 11 is supported on the upper plate portion 31*a* of the key frame 31 so that the key 11 can pivot through the key supporting portions 32. In this example, the key supporting portions 32 are provided at the rear end portion of the key 11. Furthermore, the keyboard apparatus has the stopper member 34 and the key switch 35 configured almost similarly to those of the first to third embodiments.

Furthermore, the keyboard apparatus has the hammer 52 supported by a hammer supporting member 51 so that the hammer 52 can pivot. The hammer supporting member 51 extends downward from the undersurface of the upper plate portion 31 such that the hammer supporting member 51 is situated at the middle of the key 11 in the front-rear direction. The hammer 52 is formed of a base portion 52*a*, a connecting rod 52*b* and a mass body 52*c*. The base portion 52*a* is supported at the middle portion thereof by the hammer supporting portion 51 so that the hammer 52 can pivot about the pivot axis C. More specifically, the mass body 52*c* pivots up and down. The base portion 52*a* has bifurcated legs at the front portion. Between the legs, a drive shaft 53*a* provided on an extending portion 53 extending vertically from the undersurface of the key 11 penetrates so that the drive shaft 53*a* can slide. The extending portion 53 penetrates through a throughhole provided on the upper plate portion 31*a* so that the extending portion 53 can be displaced up and down. As a result, the base portion 52*a* is to be displaced downward when the key 11 is depressed. The connecting rod 52*b* extends in the front-rear direction to connect the base portion 52*a* with the mass body 52*c*. The mass body 52*c* urges the front end of the hammer 52 upward, using the mass of the mass body 52. Below the mass body 52*c*, a stopper member 54 for preventing the mass body 52*c* from moving downward is fastened to the frame FR. In a state where the key 11 is being released, as a result, the mass body 52*c* is situated on the stopper member 54 to urge the front end portion of the key 11 upward, so that the key 11 is kept roughly horizontal because of the engagement of the engagement portion 11*c* with the stopper member 34.

The upper plate portion 31*a* has the supporting portion 31*d* which is situated to face the mass body 52*c* and protrudes downward to have an undersurface which is situated at a roughly horizontal position. To the undersurface of the supporting portion 31*d*, the reaction force generation member 21 (22) which is similar to that of the first embodiment is fastened such that the top portion 21*b* (22*b*) is situated downward. The axis line Y1 of the reaction force generation member 21 (22) is almost vertical. The upper surface of the mass body 52*c* serves as a flat depression portion 52*d* to face the undersurface of the top portion 21*b* (22*b*) of the reaction force generation member 21 (22) when the key is being released. When the key is depressed, the depression portion 52*d* moves upward to come into contact with the undersurface of the top portion 21*b* (22*b*) to depress the reaction force generation member 21 (22). In this example as well, the reaction force generation member 21 (22) is elastically deformed by the depression. At the point in time when the reaction force reaches its peak, as a result, the axis line Y1 of the reaction force generation member 21 (22) becomes orthogonal to the plane P1 (the contact surface between the upper surface of the depression portion 52*d* and the undersurface of the top portion 21*b* (22*b*)) extending from the upper surface of the depression portion 52*d* to include the pivot axis C. In other words, the normal line of the plane P1 becomes parallel to the axis line Y1.

According to the second applied example configured as above, when the key 11 is depressed, the drive shaft 53*a* of the extending portion 53 moves downward, so that the hammer 52 pivots in the counterclockwise direction. Then, the depression portion 52*d* of the mass body 52*c* of the hammer 52 depresses the reaction force generation member 21 (22), so that the reaction force generation member 21 (22) elastically deforms to buckle. When the key 11 is released, the hammer 52 pivots in the clockwise direction because of the mass of the mass body 52*c*, so that the front end portion of the key 11 moves upward to return to the roughly horizontal state because of the engagement of the engagement portion 11*c* with the stopper member 34. When the key is depressed as above, at the point in time when the reaction force of the reaction force generation member 21 (22) reaches its peak immediately before buckling, the normal line of the plane P1 becomes parallel to the axis line Y1 of the reaction force generation member 21 (22). According to the second applied example as well, as a result, similarly to the first embodiment, in response to a depression of the key 11, the reaction force generation member 21 (22) generates a reaction force having a clear peak immediately before buckling. Therefore, the player can recognize a clear feeling of click immediately before the buckling, so that the second applied example can provide the player with the touch of keys similar to the touch of let-off perceived on a piano.

Similarly to the first embodiment, furthermore, the keyboard apparatus having the hammer 52 may be configured such that the reaction force generation member 21 (22) is provided below the key 11 so that the reaction force generation member 21 (22) is situated on the upper surface of the upper plate portion 31*a* of the key frame 31 (see broken lines in the figure).

In the second applied example as well, furthermore, the mass body 52*c* and the reaction force generation member 21 (22) may be configured such that the direction of the axis line Y1 of the reaction force generation member 21 (22) exists within an angle between the normal line of the plane including the pivot axis C and the depression point of the depression portion 52*d* at the point in time when the depression portion 52*d* of the mass body 52*c* comes into contact with the top portion 21*b* (22*b*) of the reaction force generation member 21 (22) and the normal line of the plane including the pivot axis C and the depression point of the depression portion 52*d* at the point in time when the depression portion 52*d* finishes depressing the reaction force generation member 21 (22).

d3. Third Applied Example

Figure 17:
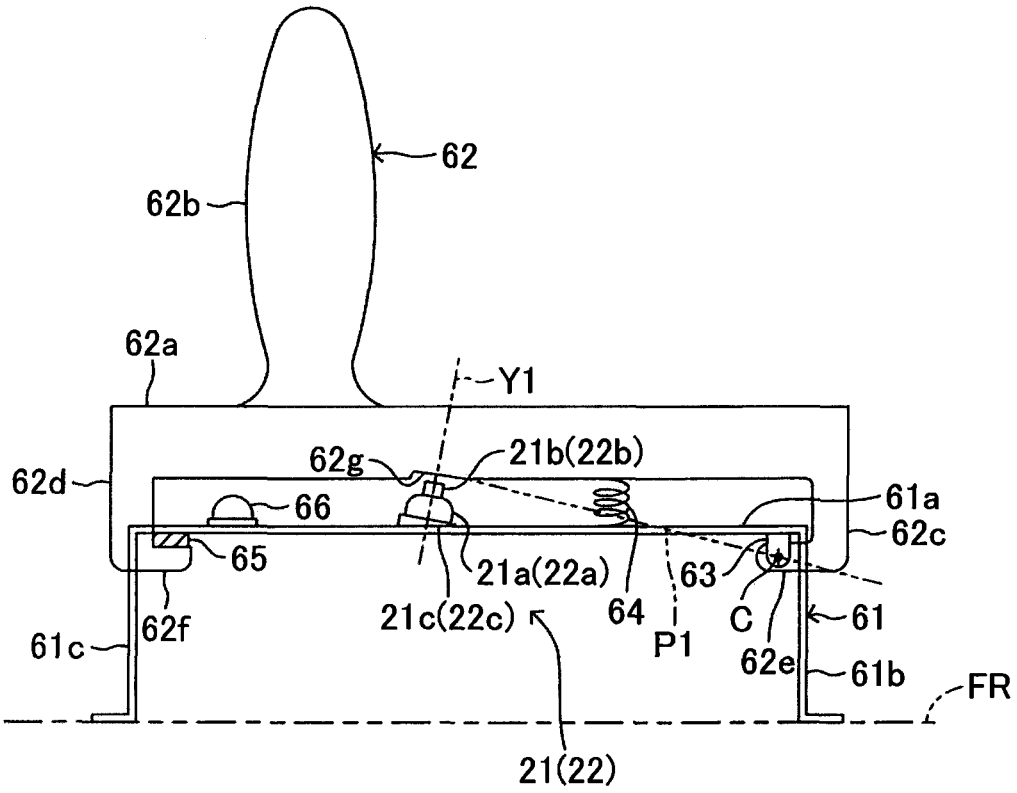
FIG. 17 is a schematic side view of a manual operating element device according to the third applied example of the invention.

Next, an operating element device of the third applied example having a hand-operated operating element 62 which is different from the key 11 will be explained with reference to a drawing. FIG. 17 is a side view in which the operating element device of the third applied example is seen from the right. The operating element device is incorporated into an electronic musical instrument, an electric musical instrument or the like. The operating element device is also incorporated into the other electrical products. The operating element device has an operating element frame 61 fastened to the frame FR, and an operating element 62 provided on the operating element frame 61 so that the operating element 62 can pivot. The operating element frame 61 has a horizontally extending upper plate portion 61*a* and a pair of legs 61*b* and 61*c* extending downward from the rear end and the front end of the upper plate portion 61*a* so that the operating element frame 61 can be fastened to the frame FR with the legs 61*b* and 61*c*.

The operating element 62 has a base portion 62*a* which extends horizontally in the front-rear direction above the upper plate portion 61*a* of the operating element frame 61 in a state where the operating element 62 is not being operated, and an operating portion 62*b* which extends upward on the base portion 62*a* and is formed integrally with the base portion 62*a*. On the rear end and the front end of the base portion 62*a*, extending portions 62*c* and 62*d* extending downward are provided such that the extending portions 62*c* and 62*d* are formed integrally with the base portion 62*a*. On the lower end of the extending portion 62*c*, a protruding portion 62*e* which protrudes frontward is provided. The protruding portion 62*e* is inserted through a through-hole provided on the leg 61*b* of the operating element frame 61 from the rear such that the protruding portion 62*e* is situated below the upper plate portion 61*a*. On the lower end of the extending portion 62*d*, an engagement portion 62*f* which protrudes rearward is provided. The engagement portion 62*f* is inserted through a through-hole provided on the leg 61*c* of the operating element frame 61 from the front such that the engagement portion 62*f* is situated below the upper plate portion 61*a*.

Furthermore, the operating element device also has a supporting portion 63, a spring 64, a stopper member 65 and a switch 66. The supporting portion 63 extends downward from the undersurface of the rear end of the upper plate portion 61*a* of the operating element frame 61 to support the protruding portion 62*e* of the operating element 62 so that the operating element 62 can pivot about the pivot axis C. The spring 64 is provided between the upper surface of the upper plate portion 61*a* of the operating element frame 61 and the base portion 62*a* of the operating element 62 to urge the front end portion of the operating element 62 upward. The stopper member 65 is provided on the undersurface of the front end of the upper plate portion 61*a* of the operating element frame 61 to restrict upward move of the base portion 62*a* of the operating element 62 by the engagement with the engagement portion 62*f*. In a state where the operating element 62 is not being operated, as a result, the front end of the operating element 62 is urged upward by the spring 64, while the engagement with the stopper member 65 restricts upward move of the operating element 62, so that the base portion 62*a* is kept at a roughly horizontal position. The switch 66 is configured similarly to the above-described key switch 35, and is fastened to the upper surface of the upper plate portion 61*a* of the operating element frame 61. Therefore, when the operating portion 62*b* of the operating element 62 is operated downward, the switch 66 is turned from an off-state to an on-state. By the on/off operation of the switch 66, an electric control circuit which is not shown is controlled.

To the upper plate portion 61*a* of the operating element frame 61, the reaction force generation member 21 (22) similar to that of the first embodiment is fastened such that the reaction force generation member 21 (22) is situated at a middle position in the front-rear direction of the upper plate portion 61*a*. In this applied example, however, the axis line Y1 of the reaction force generation member 21 (22) is inclined such that the upper side tilts rearward. On the undersurface of the base portion 62*a* of the operating element 62, a depression portion 62*g* is provided such that the depression portion 62*g* is situated to face the reaction force generation member 21 (22). The depression portion 62*g* is configured such that in the state where the operating element 62 is not being operated, the depression portion 62*g* tilts so that the front side of the depression portion 62*g* is higher than the rear side. In this case, when the operating portion 62*b* of the operating element 62 is operated downward, the depression portion 62*g* moves downward to come into contact with the upper surface of the top portion 21*b* (22*b*) to depress the reaction force generation member 21 (22). By the depression, in this case as well, the reaction force generation member 21 (22) is elastically deformed. At the point in time when the reaction force reaches its peak, furthermore, the axis line Y1 of the reaction force generation member 21 (22) becomes orthogonal to the plane P1 (the contact surface between the undersurface of the depression portion 62*g* and the upper surface of the top portion 21*b* (22*b*)) extending from the undersurface of the depression portion 62*g* to include the pivot axis C. In other words, the normal line of the plane P1 becomes parallel to the axis line Y1.

According to the third applied example configured as above, when the operating element 62 is not being operated, by the urging force of the spring 64, the front end of the base portion 62*a* of the operating element 62 is urged upward, while the engagement portion 62*f* comes into contact with the stopper member 65 to keep the base portion 62*a* at a roughly horizontal position. When the operating element 62 is operated to move downward, the front end of the base portion 62*a* moves downward, so that the depression portion 62*g* depresses the reaction force generation member 21 (22) to make the reaction force generation member 21 (22) elastically deform to buckle. If the operating element 62 is then released, the base portion 62*a* returns to a roughly horizontal position, as described above. When the operating element 62 is operated as above, at the point in time when the reaction force of the reaction force generation member 21 (22) reaches its peak immediately before the buckling, the normal line of the plane P1 becomes parallel to the axis line Y1 of the reaction force generation member 21 (22). According to the third applied example as well, as a result, similarly to the first embodiment, in response to the operation of the operating element 62, the reaction force generation member 22 generates a reaction force having a clear peak immediately before buckling. Therefore, the operator can recognize a clear feeling of click immediately before the buckling, so that the third applied example can provide the operator with favorable sense of operation.

In the third applied example as well, furthermore, the operating element 62 and the reaction force generation member 21 (22) may be configured such that the direction of the axis line Y1 of the reaction force generation member 21 (22) exists within an angle between the normal line of the plane including the pivot axis C and the depression point of the depression portion 62*g* at the point in time when the depression portion 62*g* of the operating element 62 comes into contact with the top portion 21*b* (22*b*) of the reaction force generation member 21 (22) and the normal line of the plane including the pivot axis C and the depression point of the depression portion 62*g* at the point in time when the depression portion 62*g* finishes depressing the reaction force generation member 21 (22). Furthermore, although only the hand-operated operating element 62 was explained in the third applied example, the present invention can be also applied to a pedal operating element or the like operated with a human's different part (such as a foot).

d4. Fourth Applied Example

Figure 18:
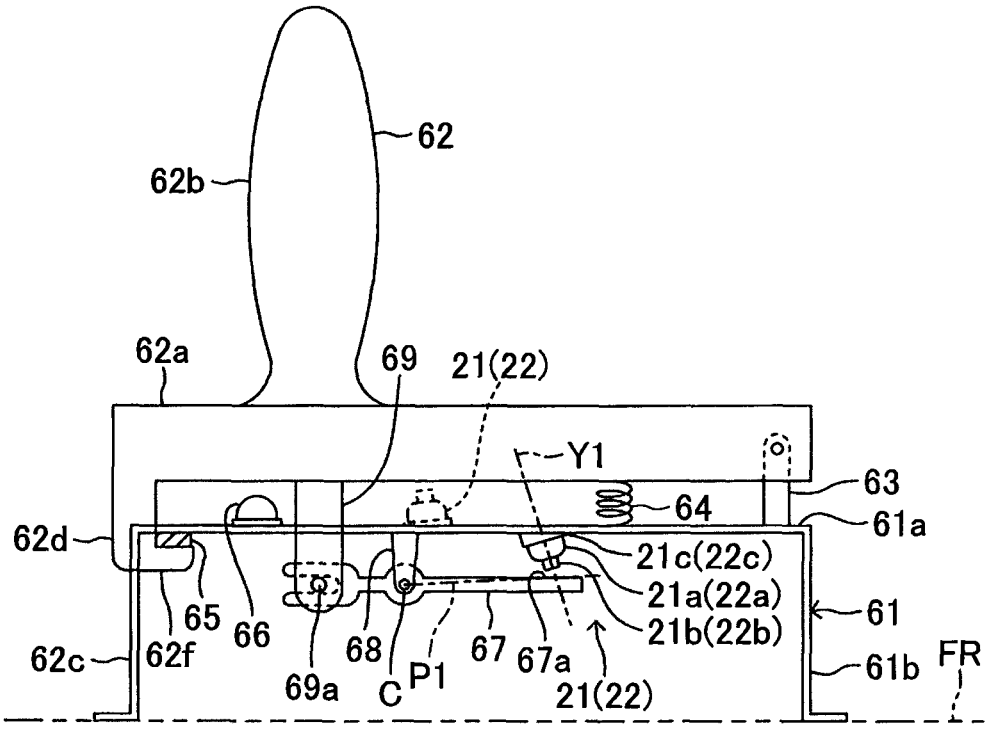
FIG. 18 is a schematic side view of the manual operating element device according to the fourth applied example of the invention.
Figure 19:
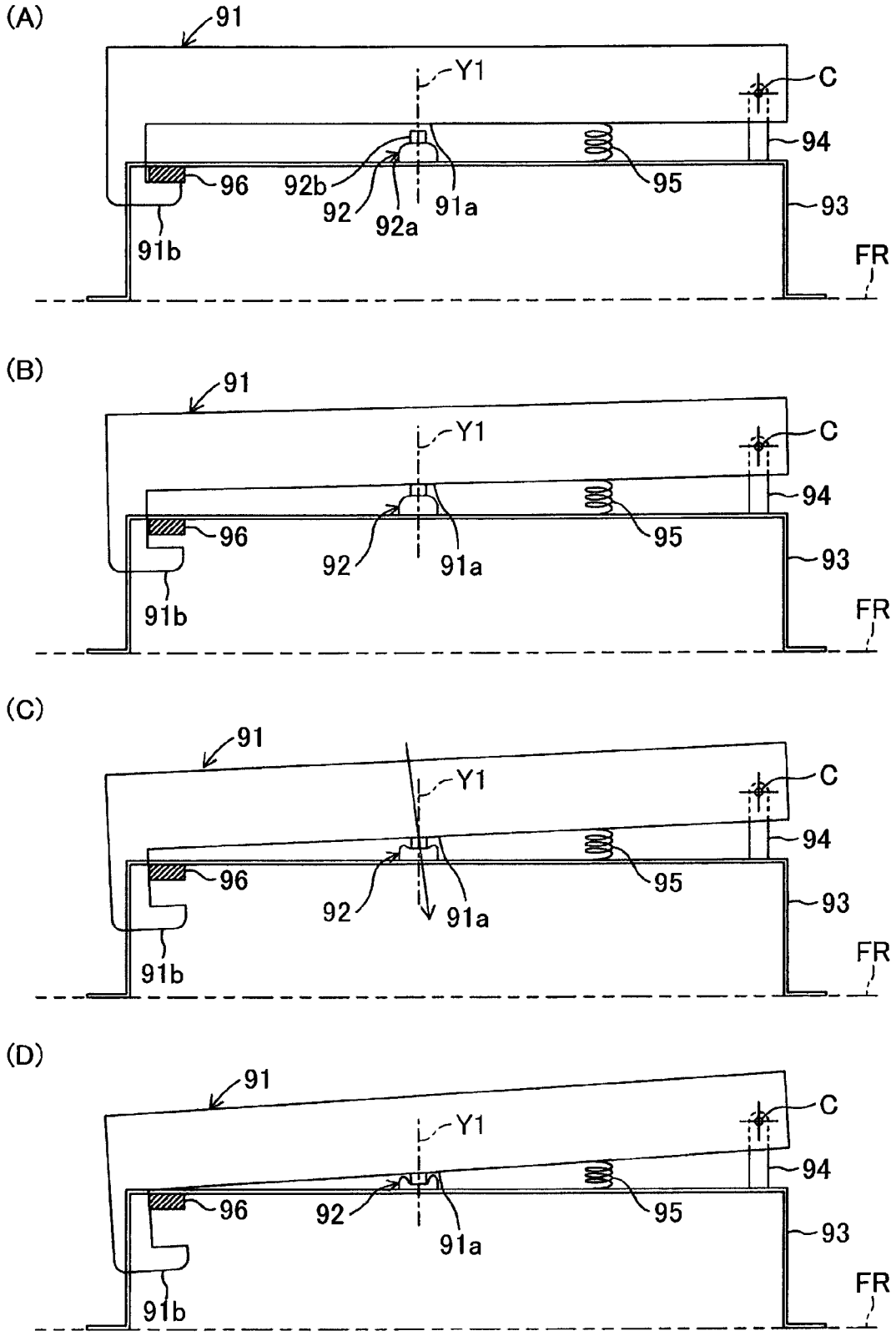
FIGS. 19(A) to (D) are schematic side views indicating states ranging from prior to the start to the end of a depression of a key of a conventional keyboard apparatus.

Next, an operating element device of the fourth applied example obtained by modifying the operating element device explained in the third applied example will be explained with reference to a drawing. FIG. 18 is a side view in which the operating element device of the fourth applied example is seen from the right. In the fourth applied example, the rear end of the base portion 62*a* extending horizontally in a state where the operating element 62 is not being operated is supported by the supporting portion 63 erected on the upper plate portion 61*a* of the operating element frame 61 so that the operating element 62 can pivot. The fourth applied example does not have the extending portion 62*c* and the protruding portion 62*e* included in the third applied example.

Below the upper plate portion 61*a* of the operating element frame 61, a pivot lever 67 extending in the front-rear direction is provided. The pivot lever 67 is supported at the middle portion thereof by a supporting member 68 such that the pivot lever 67 can pivot about the pivot axis C. The pivot lever 67 has bifurcated legs at the front portion. Between the legs, a drive shaft 69*a* provided on an extending portion 69 extending vertically from the undersurface of the base portion 62*a* of the operating element 62 penetrates so that the drive shaft 69*a* can slide. The extending portion 69 penetrates through a through-hole provided on the upper plate portion 61*a* so that the extending portion 69 can be displaced up and down. Resultantly, if the operating element 62 is operated to move downward, the front end of the pivot lever 67 moves downward so that the pivot lever 67 pivots in the counterclockwise about the pivot axis C. In a state where the operating element 62 is not being operated, the base portion 62*a* of the operating element 62 is urged upward by the spring 64, so that the extending portion 69 is situated upward.

To the undersurface of the upper plate portion 61*a* of the operating element frame 61, the reaction force generation member 21 (22) similar to that of the first embodiment is fastened, with the top portion 21*b* (22*b*) being directed downward. In this applied example, the axis line Y1 of the reaction force generation member 21 (22) is inclined such that the lower portion is inclined rearward. On the upper surface of the pivot lever 67, a flat depression portion 67*a* is provided such that the depression portion 67*a* faces the reaction force generation member 21 (22). In this applied example, when the operating portion 62*b* of the operating element 62 is operated downward, the pivot lever 67 pivots to move the depression portion 67*a* upward to come into contact with the undersurface of the top portion 21*b* (22*b*) to depress the reaction force generation member 21 (22). In this applied example as well, the reaction force generation member 21 (22) is elastically deformed by the depression. At the point in time when the reaction force reaches its peak, furthermore, the axis line Y1 of the reaction force generation member 21 (22) becomes orthogonal to the plane P1 (the contact surface between the upper surface of the depression portion 67*a* and the undersurface of the top portion 21*b* (22*b*)) extending from the upper surface of the depression portion 67*a* to include the pivot axis C. In other words, the normal line of the plane P1 becomes parallel to the axis line Because the configuration other than the above is similar to that of the third applied example, similar parts of the fourth applied example are given the same numbers as the third applied example to omit explanations about the parts.

According to the fourth applied example configured as above, when the operating element 62 is not being operated, the front end of the base portion 62*a* of the operating element 62 is urged upward by the urging force of the spring 64, while the engagement portion 62*f* comes into contact with the stopper member 65 to keep the base portion 62*a* at a roughly horizontal position. When the operating element 62 is operated to move downward, the front end of the base portion 62*a* moves downward to move the extending portion 69 downward to make the pivot lever 67 pivot in the counterclockwise, so that the depression portion 67*a* depresses the reaction force generation member 21 (22) to make the reaction force generation member 21 (22) elastically deform to buckle. If the operating element 62 is then released, the base portion 62*a* returns to the roughly horizontal position, as described above. When the operating element 62 is operated as above, at the point in time when the reaction force of the reaction force generation member 21 (22) reaches its peak immediately before the buckling, the normal line of the plane P1 becomes parallel to the axis line Y1 of the reaction force generation member 21 (22). According to the fourth applied example as well, as a result, similarly to the first embodiment, in response to the operation of the operating element 62, the reaction force generation member 21 (22) generates a reaction force having a clear peak immediately before buckling. Therefore, the operator can recognize a clear feeling of click immediately before the buckling, so that the fourth applied example can provide the operator with favorable sense of operation.

Furthermore, the operating element having the above-described pivot lever 67 may be modified such that the reaction force generation member 21 (22) is provided below the operating element 62 such that the reaction force generation member 21 (22) is situated on the upper surface of the upper plate portion 61*a* of the operating element frame 61 (see broken lines in the figure).

In the fourth applied example as well, furthermore, the operating element 62 and the reaction force generation member 21 (22) may be configured such that the direction of the axis line Y1 of the reaction force generation member 21 (22) exists within an angle between the normal line of the plane including the pivot axis C and the depression point of the depression portion 67*a* at the point in time when the depression portion 67*a* of the pivot lever 67 comes into contact with the top portion 21*b* (22*b*) of the reaction force generation member 21 (22) and the normal line of the plane including the pivot axis C and the depression point of the depression portion 67*a* at the point in time when the depression portion 67*a* finishes depressing the reaction force generation member 21 (22).

d5. Modification of the Applied Examples

The first to fourth applied examples are configured such that the plane P1 includes the pivot axis C. Instead of such a configuration, however, similarly to the second embodiment, the first to fourth applied examples may be modified such that at the point in time when the reaction force reaches its peak, the axis line Y1 of the reaction force generation member 21 (22) becomes orthogonal to the depression surface of the depression portion 42*a*, 52*d*, 62*g* or 67*a*, that is, to the plane P2 which is the contact surface between the depression portion 42*a*, 52*d*, 62*g* or 67*a* and the top portion 21*b* (22*b*) and which does not include the pivot axis C. More specifically, the applied examples may be modified such that the axis line Y1 becomes orthogonal to the normal line of the plane P2 when the reaction force reaches its peak. Furthermore, the applied examples may be modified such that the axis line Y1 of the reaction force generation member 21 (22) falls within an angle between the normal line of the depression surface of the depression portion 42*a*, 52*d*, 62*g* or 67*a* at the point in time when the depression portion 42*a*, 52*d*, 62*g* or 67*a* comes into contact with the top portion 21*b* (22*b*) and the normal line of the depression surface of the depression portion 42*a*, 52*d*, 62*g* or 67*a* at the point in time when the depression portion 42*a*, 52*d*, 62*g* or 67*a* finishes depressing the reaction force generation member 21 (22).

Furthermore, the first to fourth applied examples may be modified similarly to the third embodiment such that the reaction force generation member 21 (22) is provided on the mass body 42 or 52*c*, or the base portion 62*a* of the operating element 62 which are pivoting bodies, with a depression portion being provided at a position opposed to the reaction force generation member 21 (22).

To the first to fourth applied examples as well, furthermore, the various modifications of the first and second embodiments can be applied.

e. Other Modifications

The first to third embodiments, the other applied examples and their modifications are configured such that the reaction force generation member 21 or 22 is provided separately from the key switch 35 or the switch 66. Instead of such a configuration, however, the key switch 35 or the switch 66 may be configured similarly to the reaction force generation member 21 or 22 so that the key switch 35 or the switch 66 can be used as a reaction force generation member. In this modification, the body portion 21*a* or 22*a* is to have a two-tier configuration having an inner portion and an outer portion, with a tubular less-deformable switch portion being provided between the inner portion and outer portion. In this modification, more specifically, by deformation of the outer portion, an increasing reaction force is generated in response to a depression of the key, while a contact provided on a board is opened or closed by the switch portion, with a reaction force against the key-depression being generated by deformation and buckling of the inner portion.

Furthermore, the first to third embodiments, the applied examples and their modifications are configured such that the key 11 is supported by the key supporting portions 32 so that the key 11 can pivot about the pivot axis C, the mass body 42 is supported by the supporting member 41 so that the mass body 42 can pivot about the pivot axis C, the hammer 52 is supported by the hammer supporting member 51 so that the hammer 52 can pivot about the pivot axis C, the operating element 62 is supported by the supporting portion 63 so that the operating element 62 can pivot about the pivot axis C, or the pivot lever 67 is supported by the supporting member 68 so that the pivot lever 67 can pivot about the pivot axis C. However, the first to third embodiments, the applied examples and their modifications may be modified to use a hinge-type pivot axis by providing a plate-like thin portion for the end portion of the pivot axis C of the key 11, the mass body 42, the hammer 52 and the pivot lever 67 which are the pivoting bodies to allow the supporting members to support the pivoting bodies at the opposite end so that the elastic deformation of the thin portion can allow the key 11, the mass body 42, the hammer 52 and the pivot lever 67 to pivot.

In this modification, the hinge-type pivot axis, that is, the above described pivot axis C slightly varies with the pivoting of the key 11, the mass body 42, the hammer 52 or the pivot lever 67. More specifically, since the position of the pivot axis C varies with passage of time, the pivot axis C defined in this specification represents a pivot axis (pivot central shaft) of the key 11, the mass body 42, the hammer 52 and the pivot lever 67 at each point in time. For instance, a pivot axis at the point in time when the depression portion of this invention comes into contact with the reaction force generation member is a pivot axis (pivot central shaft) of that point in time, and a pivot axis at the point in time when the depression portion finishes depressing the reaction force generation member is a pivot axis (pivot central shaft) of that point in time.

In the explanations about the reaction force generation members 21 and 22 of the first to third embodiments, the other applied examples and their modifications, each of the plurality of reaction force generation members 21 and 22 is defined as having the body portion 21*a* or 22*a*, the top portion 21*b* or 22*b* and the base portion 21*c* or 22*c*. In this case, the body portions 21*a* or 22*a* and the top portions 21*b* or 22*b* are away with each other to be located separately. However, the neighboring base portions 21*c* or 22*c* may be integrally provided or may be away with each other to be located separately.

What is claimed is:

1. An operating element device comprising:

a pivoting body pivotally supported so that the pivoting body is pivotable about a pivot axis in response to a force directly or indirectly exerted on the pivoting body by an operator; and a reaction force generation member that becomes elastically deformed by a depression exerted in an axis line direction and generates a reaction force against the depression, the reaction force generation member increasing the reaction force from a beginning with an increasing amount of elastic deformation by the depression, and buckling to reduce the reaction force after a peak of the reaction force; and a fastened member, wherein one of the pivoting body or the fastened member includes a depression portion, wherein the reaction force generation member is disposed on one of the fastened member or the pivoting body, opposed to the depression portion, so that the depression portion depresses the reaction force generation member in an axis line direction in response to pivoting of the pivoting body, wherein the depression portion and the reaction force generation member are configured so that the axis line direction of the reaction force generation member exists within an angle between a first normal line of a plane including the pivot axis and a depression point of the depression portion at a first point in time when the depression portion comes into contact with the reaction force generation member, and a second normal line of the plane including the pivot axis and the depression point of the depression portion at a second point in time when the depression portion finishes depressing the reaction force generation member.

2. The operating element device according to claim 1, wherein a third normal line of the plane including the pivot axis and the depression point of the depression portion at a third point in time when the reaction force of the reaction force generation member reaches its peak becomes parallel to the axis line of the reaction force generation member.

3. The operating element device according to claim 1, wherein a plane on which the depression portion comes into contact with the reaction force generation member at a third point in time when the reaction force generation member generates the peak reaction force includes the pivot axis of the pivoting body.

4. The operating element device according to claim 1, wherein the depression portion and the reaction force generation member are configured so that a first normal direction of the depression surface of the depression portion with respect to the axis line of the reaction force generation member before a start of pivoting of the pivoting body is inclined toward a second normal direction of the depression surface of the depression portion with respect to the axis line of the reaction force generation member before the start of pivoting of the pivoting body that allows a third normal line of the depression surface of the depression portion to become parallel to the axis line of the reaction force generation member at the first point in time, against the first normal direction of the depression surface of the depression portion with respect to the axis line of the reaction force generation member before the start of pivoting of the pivoting body that allows the third normal line of the depression surface of the depression portion to become parallel to the axis line of the reaction force generation member at a third point in time when the reaction force of the reaction force generation member reaches its peak.

5. The operating element device according to claim 1, wherein the reaction force generation member has an elastically deformable portion that is point symmetric about a center corresponding to the axis line on a plane cross section orthogonal to the axis line and is elastically deformed by a load.

6. The operating element device according to claim 5, wherein the elastically deformable portion is made of an elastic material having a dome shape.

7. The operating element device according to claim 5, wherein:

the reaction force generation member is further includes a base portion that is resistant to being elastically deformed by a load from the depression exerted in the axis line direction, the base portion is fastened to a mounting surface to fasten the reaction force generation member to the mounting surface, and a thickness of the base portion varies according to position thereof to allow the axis line direction of the reaction force generation member to incline against a third normal line of the mounting surface.

8. The operating element device according to claim 7, wherein a normal direction of an upper surface of the base portion of the reaction force generation member is parallel to the axis line of the reaction force generation member.

9. The operating element device according to claim 7, wherein the reaction force generation member is fastened to the mounting surface inclined against the depression surface of the depression portion in a state where the operating element device is not being operated by the operator.

10. An operating element device comprising:

a pivoting body pivotably supported so that the pivoting body is pivotable about a pivot axis in response to a force directly or indirectly exerted on the pivoting body by an operator; and a reaction force generation member that becomes elastically deformed by a depression exerted in an axis line direction and generates a reaction force against the depression, the reaction force generation member increasing the reaction force from a beginning with an increasing amount of elastic deformation by the depression, and buckling to reduce the reaction force after a peak of the reaction force; and a fastened member, wherein one of the pivoting body or the fastened member includes a depression portion, wherein the reaction force generation member is disposed on one of the fastened member or the pivoting body, opposed to the depression portion, so that the depression portion depresses the reaction force generation member in an axis line direction in response to pivoting of the pivoting body, wherein the depression portion and the reaction force generation member are configured so that the axis line direction of the reaction force generation member exists within an angle between a first normal line of a depression surface of the depression portion against the reaction force generation member at a first point in time when the depression portion comes into contact with the reaction force generation member, and a second normal line of the depression surface of the depression portion against the reaction force generation member at a second point in time when the depression portion finishes depressing the reaction force generation member.

11. The operating element device according to claim 10, wherein a third normal line of the depression surface of the depression portion at a third point in time when the reaction force of the reaction force generation member reaches its peak becomes parallel to the axis line of the reaction force generation member.

12. The operating element device according to claim 10, wherein a plane on which the depression portion comes into contact with the reaction force generation member at a third point in time when the reaction force generation member generates the peak reaction force includes the pivot axis of the pivoting body.

13. The operating element device according to claim 10, wherein the depression portion and the reaction force generation member are configured so that a first normal direction of the depression surface of the depression portion with respect to the axis line of the reaction force generation member before a start of pivoting of the pivoting body is inclined toward a second normal direction of the depression surface of the depression portion with respect to the axis line of the reaction force generation member before the start of pivoting of the pivoting body that allows the first normal line of the depression surface of the depression portion to become parallel to the axis line of the reaction force generation member at the first point in time, against the first normal direction of the depression surface of the depression portion with respect to the axis line of the reaction force generation member before the start of pivoting of the pivoting body that allows the third normal line of the depression surface of the depression portion to become parallel to the axis line of the reaction force generation member at a third point in time when the reaction force of the reaction force generation member reaches its peak.

14. The operating element device according to claim 10, wherein the reaction force generation member has an elastically deformable portion that is point symmetric about a center corresponding to the axis line on a plane cross section orthogonal to the axis line and is elastically deformed by a load.

15. The operating element device according to claim 14, wherein the elastically deformable portion is made of an elastic material having a dome shape.

16. The operating element device according to claim 14, wherein:

the reaction force generation member includes a base portion that is resistant to being elastically deformed by a load from the depression exerted in the axis line direction, the base portion is fastened to a mounting surface to fasten the reaction force generation member to the mounting surface, and a thickness of the base portion varies according to position thereof to allow the axis line direction of the reaction force generation member to incline against a third normal line of the mounting surface.

17. The operating element device according to claim 16, wherein a normal direction of an upper surface of the base portion of the reaction force generation member is parallel to the axis line of the reaction force generation member.

18. The operating element device according to claim 16, wherein the reaction force generation member is fastened to the mounting surface inclined against the depression surface of the depression portion in a state where the operating element device is not being operated by the operator.

* * * * *